US012022954B2

(12) United States Patent
Liu et al.

(10) Patent No.: US 12,022,954 B2
(45) Date of Patent: Jul. 2, 2024

(54) READY TO ASSEMBLE STRUCTURAL SYSTEM FOR A BED

(71) Applicant: HHC CHANGZHOU CORPORATION, Changzhou (CN)

(72) Inventors: Chih Hsiung Liu, Benoni (ZA); Mei Jun Xu, Jiujiang (CN); Hai Guo Jiang, Changzhou (CN); Kui Zhao, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 188 days.

(21) Appl. No.: 17/174,260

(22) Filed: Feb. 11, 2021

(65) Prior Publication Data

US 2022/0248862 A1 Aug. 11, 2022

(51) Int. Cl.
*A47C 20/04* (2006.01)
*A47C 19/04* (2006.01)
*A47C 19/12* (2006.01)

(52) U.S. Cl.
CPC ..... *A47C 20/041* (2013.01); *A47C 19/045* (2013.01); *A47C 19/124* (2013.01)

(58) Field of Classification Search
CPC ... A47C 20/041; A47C 19/045; A47C 19/124; A47C 19/005; A47C 19/024; A47C 17/86; A47C 19/021; A47C 19/022
USPC ..... 5/618
See application file for complete search history.

(56) References Cited

U.S. PATENT DOCUMENTS 4,545,084 A * 10/1985 Peterson ..... A61G 7/018 403/197
4,660,236 A * 4/1987 Peterson ..... A61G 7/018 403/26
4,903,354 A * 2/1990 Yeh ..... A47C 19/022 403/292
5,269,031 A * 12/1993 Alexander ..... A47C 20/041 5/616
5,444,880 A * 8/1995 Weismiller ..... A61G 7/015 5/616
5,628,078 A * 5/1997 Pennington ..... A61G 13/10 5/613
9,526,665 B2 * 12/2016 Rawls-Meehan ..... A47C 20/08
10,306,994 B2 * 6/2019 Barr ..... A47C 19/025
10,729,253 B1 * 8/2020 Gaunt ..... A47C 27/083
2005/0251917 A1 * 11/2005 Wall ..... A47C 19/005 5/618
2006/0053555 A1 * 3/2006 Poulos ..... A61G 7/0514 5/618
2007/0157388 A1 * 7/2007 Mossbeck ..... A47C 20/041 5/618
2008/0155750 A1 * 7/2008 Mossbeck ..... A61G 7/018 5/940

(Continued)

*Primary Examiner* — Justin C Mikowski
*Assistant Examiner* — Luke Hall
(74) *Attorney, Agent, or Firm* — LAW OFFICES OF STEVEN W. WEINRIEB

(57) ABSTRACT

A ready to assemble (RTA) bed structural system comprises deck components which can be folded together so as to effectively define an interior compartment within which other components of the bed can be housed. Longitudinally and transversely extending frame members are connected together by leg members of the frame. Deck members are also connected to the frame by quick-latch components.

19 Claims, 15 Drawing Sheets

(56) References Cited

U.S. PATENT DOCUMENTS

| | | | | |
|---|---|---|---|---|
| 2009/0094748 | A1* | 4/2009 | Long | A47C 20/041 5/613 |
| 2011/0203050 | A1* | 8/2011 | Rogers | A47C 19/005 5/285 |
| 2011/0219537 | A1* | 9/2011 | Lin | A47C 19/20 5/9.1 |
| 2015/0250323 | A1* | 9/2015 | Goldsmith | A47C 19/12 5/11 |
| 2016/0316919 | A1* | 11/2016 | Goldsmith | A47C 19/025 |
| 2019/0142177 | A1* | 5/2019 | Brown | A47C 20/041 5/618 |
| 2019/0174928 | A1* | 6/2019 | Choi | B65D 85/64 |
| 2019/0183251 | A1* | 6/2019 | Niederkofler | A61G 7/0527 |
| 2019/0239652 | A1* | 8/2019 | Chung | A47C 23/02 |
| 2020/0022502 | A1* | 1/2020 | Choi | A47C 19/122 |
| 2020/0154888 | A1* | 5/2020 | Brown | A47C 20/041 |
| 2020/0154899 | A1* | 5/2020 | Brown | A47C 20/12 |
| 2020/0237105 | A1* | 7/2020 | Eskridge, III | A47C 27/14 |
| 2020/0375368 | A1* | 12/2020 | Choi | A47C 20/04 |
| 2021/0022517 | A1* | 1/2021 | Bellingroth | A47C 19/005 |
| 2021/0100366 | A1* | 4/2021 | Liu | A47C 31/123 |
| 2021/0177153 | A1* | 6/2021 | Wang | A47C 19/04 |
| 2021/0393042 | A1* | 12/2021 | Shih | A47C 19/005 |
| 2022/0061540 | A1* | 3/2022 | Ermalovich | A47C 19/005 |
| 2022/0061542 | A1* | 3/2022 | Bishop | A47C 20/041 |
| 2022/0095803 | A1* | 3/2022 | Wang | A47C 20/041 |
| 2022/0117401 | A1* | 4/2022 | Wang | A47C 21/006 |

* cited by examiner

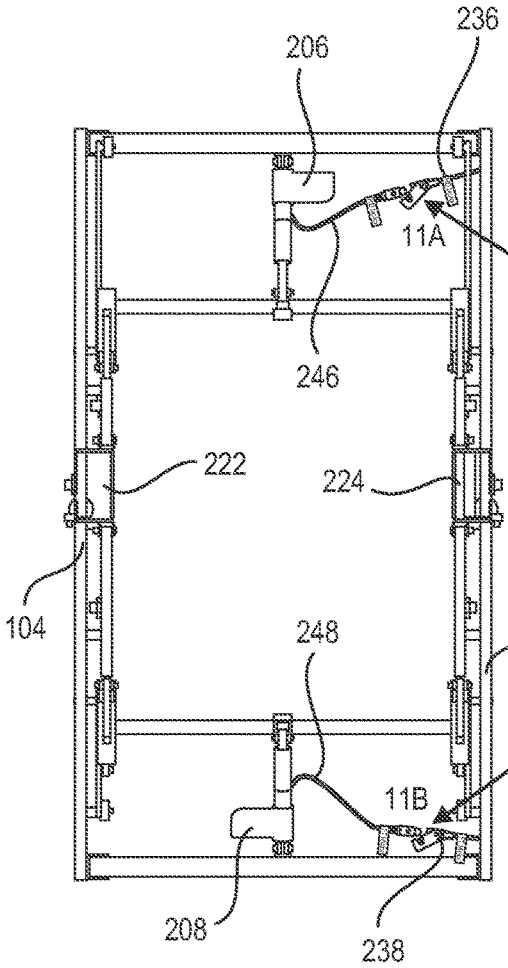
FIG. 11
FIG. 11A
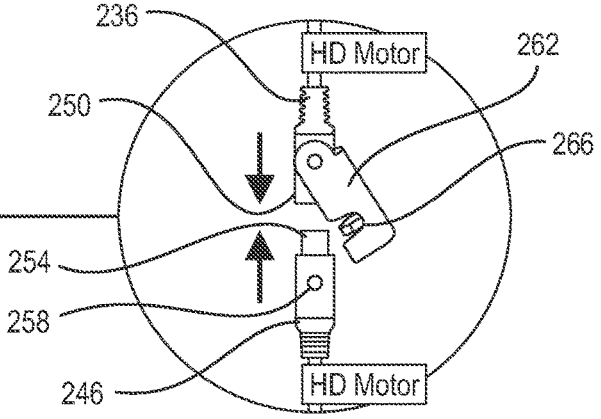
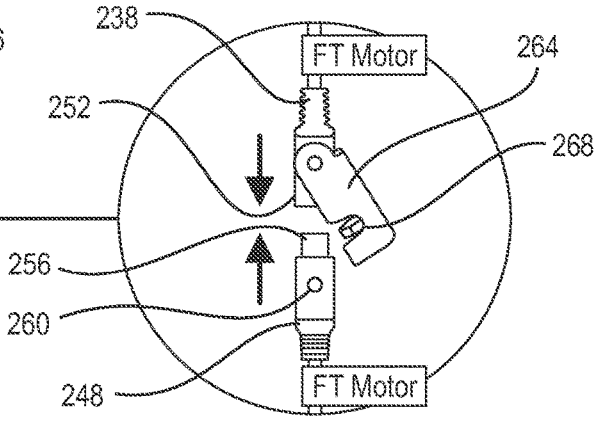
FIG. 11B
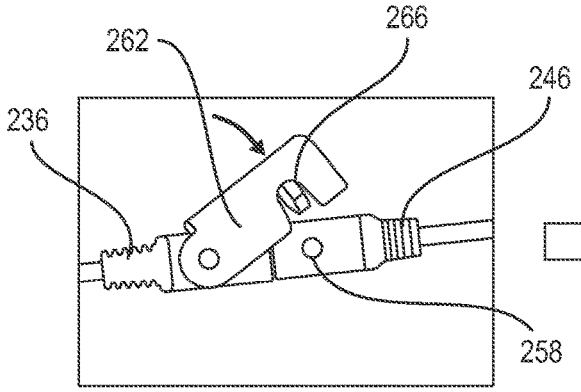
FIG. 11C
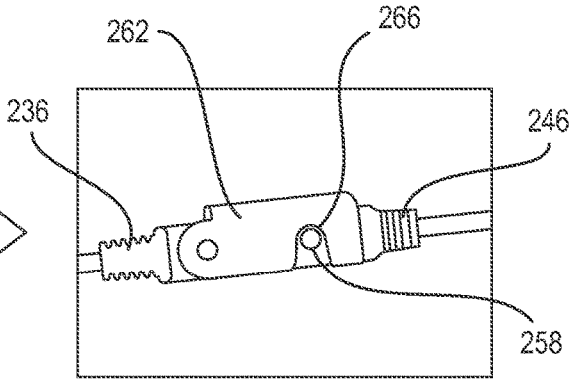
FIG. 11D

READY TO ASSEMBLE STRUCTURAL SYSTEM FOR A BED

FIELD OF THE INVENTION

The present invention relates generally to beds, and more particularly to a ready-to-assemble (RTA) structural system for a bed which is adapted to be shipped in easy-to-assemble pieces which render the bed easier to form into a package in view of the fact that the longitudinal frame members of the bed frame can be folded in half such that the resulting package has half the longitudinal length of the ultimately assembled bed. In addition, several of the deck components of the bed can be folded together so as to effectively define an enclosure defining an interior compartment within which other components of the bed can be housed. This effectively provides the package with a more compact footprint rendering the same easier and less costly to transport.

BACKGROUND OF THE INVENTION

Current purchasing trends for various different items has led many people to purchase many things on the internet or online, from books, to various personal devices or items, and even to substantially large items such as furniture, such as, for example, dining room sets, sofas, beds, and the like. One problem that has developed, however, in conjunction with such purchases, for both sellers and consumers, is shipping and the cost thereof, since most carriers, such as, for example, FEDEX or UPS, base their shipping fees or charges, in part, upon the size or volume of the article being shipped.

A need therefore exists in the art for a new and improved structural system for a bed. Another need exists in the art for a new and improved structural system for a bed which is ready-to-assemble (RTA). A further need exists in the art for a new and improved structural system for a bed which is ready-to-assemble (RTA) as a result of being packaged in pieces and is easy to assemble. A yet further need exists in the art for a new and improved structural system for a bed which is ready-to-assemble (RTA) as a result of being packaged in pieces, is easy to assemble, and is compact in size A yet still further need exists in the art for a new and improved structural system for a bed which is ready-to-assemble (RTA) as a result of being packaged in pieces, is easy to assemble, and is compact in size so as to effectively define a compact footprint. An additional need exists in the art for a new and improved structural system for a bed which is ready-to-assemble (RTA) as a result of being packaged in pieces, is easy to assemble, is compact in size so as to effectively define a compact footprint, and is therefore cost-efficient to ship or transport.

OVERALL OBJECTIVES OF THE INVENTION

An overall objective of the present invention is to provide a new and improved structural system for a bed. Another overall objective of the present invention is to provide a new and improved structural system for a bed which is ready-to-assemble (RTA). A further overall objective of the present invention is to provide a new and improved structural system for a bed which is ready-to-assemble (RTA) as a result of being packaged in pieces and is easy to assemble. A yet further overall objective of the present invention is to provide a new and improved structural system for a bed which is ready-to-assemble (RTA) as a result of being packaged in pieces, is easy to assemble, and is compact in size. A yet still further overall objective of the present invention is to provide a new and improved structural system for a bed which is ready-to-assemble (RTA) as a result of being packaged in pieces, is easy to assemble, and is compact in size so as to effectively define a compact footprint. An additional overall objective of the present invention is to provide a new and improved structural system for a bed which is ready-to-assemble (RTA) as a result of being packaged in pieces, is easy to assemble, is compact in size so as to effectively define a compact footprint, and is therefore cost-efficient to ship or transport.

SUMMARY OF THE INVENTION

The foregoing and other objectives are achieved as a result of a new and improved structural system for a bed, as constructed in accordance with the principles and teachings of the present invention, wherein the new and improved structural system for a bed comprises a bed frame which comprises left longitudinally extending frame member (LLEFM), a right longitudinally extending frame member (RLEFM), and a pair of transversely extending, oppositely disposed end members which are utilized to effectively connect the left and right longitudinally extending frame members (LLEFM/RLEFM) together. A multiplicity of adjustable upstanding support legs are attached to the corner regions of the bed frame so as to not only be fixedly secured to the overall bed frame but to also fixedly secure the oppositely disposed end members of the bed frame to the left longitudinally extending frame member (LLEFM) and the right longitudinally extending frame member (RLEFM). Additional adjustable upstanding support legs may also be fixedly secured to longitudinally intermediate portions of the left longitudinally extending frame member (LLEFM) and the right longitudinally extending frame member (RLEFM) of the bed frame. In addition, it is to be noted that each one of the adjustable upstanding support legs actually comprises two separate leg members fixedly secured together by any suitable means, such as, for example, threaded connections. The two separate leg members have different height dimensions wherein, for example, the shorter one of the two leg members may be three inches (3.00") in length, while the longer one of the two leg members may be six inches (6.00") in length. Accordingly, if only the shorter leg members are fixedly attached to the bed frame, then the bed frame will be disposed at an elevation of three inches (3.00") above the floor. If only the longer leg members are fixedly attached to the bed frame, then the bed frame will be disposed at an elevation of six inches (6.00") above the floor. Alternatively, if both the shorter and longer leg members are fixedly connected together and attached to the bed frame, then the bed frame will be disposed at an elevation of nine inches (9.00") above the floor.

Each one of the left and right longitudinally extending frame members (LLEFM/RLEFM) also comprises vertically oriented pivot mechanisms disposed at the central longitudinal regions thereof so as to permit the left and right longitudinally extending frame members (LLEFM/RLEFM) to be folded in half so as to effectively reduce or halve the longitudinal extent or length of the left and right longitudinally extending frame members (LLEFM/RLEFM) of the bed frame. Alternatively, the left and right longitudinally extending frame members (LLEFM/RLEFM) could each comprise horizontally oriented pivot mechanisms disposed at the central longitudinal regions thereof so as to permit the left and right longitudinally extending frame members (LLEFM/RLEFM) to be folded in half so as to likewise effectively reduce or halve the longitudinal extent or length of the left and right longitudinally extending frame members (LLEFM/RLEFM) of the bed frame. Still further, head deck, lumbar deck, thigh deck, and foot deck members are movably mounted upon the bed frame and are operatively controlled by means of respective foot and head linear actuators comprising motors and telescopic tube mechanisms, and a plurality of support members, mounting brackets, and linkage members. While each one of the deck members is fabricated from a relatively hard material, such as, for example, wood, metal, a suitable thermoplastic material, or the like, each one of the deck members is encased within or covered by means of a suitable padding and fabric, having a predetermined thickness and resilience, so as to effectively define a continuous mattress cushion which may be fixedly attached to the left and right longitudinally extending frame members (LLEFM/RLEFM) of the bed frame so as to provide the bed frame with a substantially continuous, cushioned surface, whereby an actual mattress for the bed can then be disposed atop the mattress cushion. The seat deck member is fixedly secured to a pair of oppositely disposed housings fixedly secured at intermediate positions along both the left and right longitudinally extending frame members (LLEFM/RLEFM) of the bed frame and within one of which is located a control box for supplying electrical power to the foot and head linear actuators, while the head deck, lumbar deck, thigh deck, and foot deck are pivotally connected to the left and right longitudinally extending frame members (LLEFM/RLEFM) of the bed frame, as well as to the pair of oppositely disposed housings by means of suitable support members, mounting brackets, and linkage members which are mounted upon or affixed to the undersurface portions of the adjacent head deck, lumbar deck, thigh deck, and foot deck members so as to effectively define or preserve the substantially continuous, cushioned surface upon which the actual mattress for the bed will be disposed. Lastly, the head deck, lumbar deck, seat deck, thigh deck, and foot deck members may also be folded together in such a manner as to effectively form a shell or enclosure defining an internal compartment within which the left longitudinally extending frame member (LLEFM) and the right longitudinally extending frame member (RLEFM) of the bed frame, as well as other operative components of the bed, may be housed. In this manner, the entire bed assembly defines a package having a relatively small footprint, thereby rendering the same easy and cost-efficient to ship or transport.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 11 is a plan view of the bed frame of the new and improved ready-to-assemble (RTA) structural system for a bed, as disclosed within FIG. 10, schematically showing the electrical connections of the head and foot motors to the head and foot motor power cords electrically connected to the power control box as illustrated within FIG. 9;

FIG. 11A is an enlarged detailed view of that portion of FIG. 11 indicated by the arrowhead 11A, showing the mechanical connection defined between the head motor power cord extending to the power control box mounted within one of the longitudinally extending frame members, and an electrical power cord electrically connected to the head motor;

FIG. 11B is an enlarged detailed view of that portion of FIG. 11 indicated by the arrowhead 11B, showing the mechanical connection defined between the foot motor power cord extending to the power control box mounted within one of the longitudinally extending frame members, and an electrical power cord electrically connected to the foot motor;

FIGS. 11C and 11D are schematic views similar to that of FIG. 11B illustrating, however, that, after either the foot motor power cord and the electrical power cord electrically connected to the foot motor, or the head motor power cord and the electrical power cord electrically connected to the head motor, have been mechanically connected together, a pivotal latch mechanism, pivotally mounted upon the head motor power cord or the foot motor power cord, is pivotally moved such that a male connection pin, mounted upon the electrical power cord electrically connected to the head motor or foot motor, is effectively inserted into a female notch defined within the pivotal latch mechanism so as to effectively prevent the two power cords from being electrically disconnected;

DETAILED DESCRIPTION OF THE PREFERRED EMBODIMENT

Figure 1:
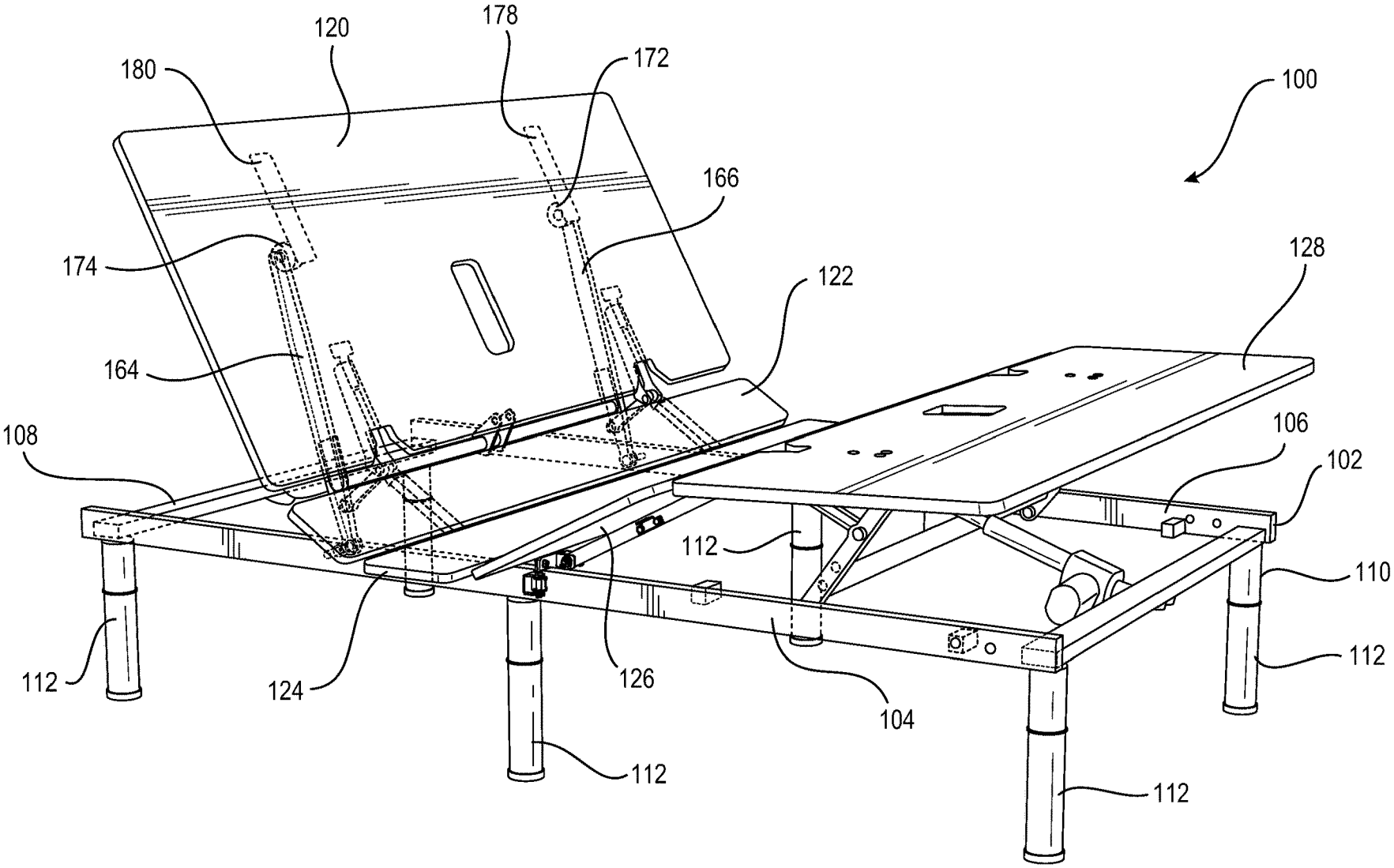
FIG. 1 is a perspective view illustrating a new and improved ready to assemble (RTA) structural system for a bed wherein the various head, lumbar, seat, thigh, and foot deck members are fixedly secured to the bed frame by means of various support members, mounting brackets, linkage members, head and foot motor driving tubes, and head and foot linear actuators, but without a padding or mattress cushion being fixedly secured to each deck member.

With reference first being made to FIG. 1, the new and improved structural system for a bed, as constructed in accordance with the principles and teachings of the present invention, is disclosed and is generally indicated by the reference character 100. More particularly, it is seen that the new and improved structural system for a bed 100 is seen to comprise a bed frame 102 which comprises a left longitudinally extending frame member (LLEFM) 104, a right longitudinally extending frame member (RLEFM) 106, and a pair of transversely extending, oppositely disposed end members 108,110 which are utilized to effectively connect the left and right longitudinally extending frame members (LLEFM/RLEFM) 104,106 together. A multiplicity of height-adjustable upstanding support legs 112 are attached to the corner regions of the bed frame 102 so as to not only be fixedly secured to the overall bed frame but to also fixedly secure the oppositely disposed end members 108,110 of the bed frame 102 to the left longitudinally extending frame member (LLEFM) 104 and the right longitudinally extending frame member (RLEFM) 106, as will be described more fully hereinafter. Additional adjustable upstanding support legs 112 may also be fixedly secured to longitudinally intermediate portions of the left longitudinally extending frame member (LLEFM) 104 and the right longitudinally extending frame member (RLEFM) 106 of the bed frame 102 so as to properly support the bed frame 102 throughout the longitudinal extent thereof. In addition, it is to be noted that each one of the adjustable upstanding support legs 112 actually comprises two separate leg members 114,116 fixedly secured together by any suitable means, such as, for example, threaded connections, as may best be appreciated from FIGS. 2 and 13. As can best be appreciated from FIGS. 2 and 13, the two separate leg members 114,116 have different height dimensions wherein, for example, the shorter one of the two leg members 114 may have a height dimension of, for example, three inches (3.00") in length, while the longer one of the two leg members 116 may have a height dimension of, for example, six inches (6.00") in length. Accordingly, if only the shorter leg members 114 are fixedly attached to the bed frame 102, then the bed frame 102 will be disposed at an elevation of three inches (3.00") above the floor, while if only the longer leg members 116 are fixedly attached to the bed frame 102, then the bed frame 102 will be at an elevation of six inches (6.00") above the floor. Alternatively, if both the shorter and longer leg members 114,116 are fixedly connected together and attached to the bed frame, then the bed frame will be disposed at an elevation of nine inches (9.00") above the floor.

Figure 8:
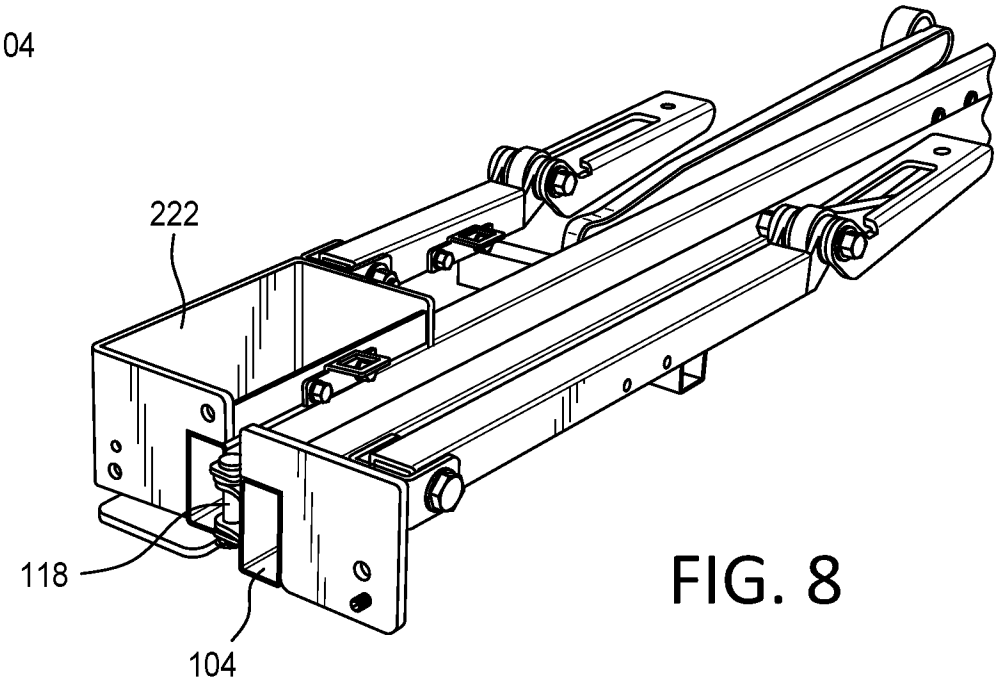
FIG. 8 is a perspective view of the longitudinally extending frame member illustrated in FIG. 7, showing, however, the longitudinally extending frame member effectively folded in half, as a result of a vertically oriented pivot mechanism being incorporated within the longitudinally extending frame member structure at a location which is substantially equidistant from the opposite ends of the longitudinally extending frame member, such that the length of the longitudinally extending frame member, when folded in half, is approximately one half the length of the longitudinally extending frame member when unfolded, thereby permitting the longitudinally extending frame member to be rendered more compact for handling and shipping or transporting purposes.

Continuing further, and with reference being made to FIG. 8, it can be best appreciated that each one of the left and right longitudinally extending frame members (LLEFM/RLEFM) 104,106 also comprises, or has incorporated therein, vertically oriented pivot mechanisms 118 which are disposed at central longitudinal regions of the left and right longitudinally extending frame members (LLEFM/RLEFM) 104,106 so as to effectively permit the left and right longitudinally extending frame members (LLEFM/RLEFM) 104,106 to be folded in half, in a side-by-side manner or arrangement, so as to effectively reduce, or more specifically, halve the longitudinal extent or length of the left and right longitudinally extending frame members (LLEFM/RLEFM) 104,106 of the bed frame 102.

Figure 2:
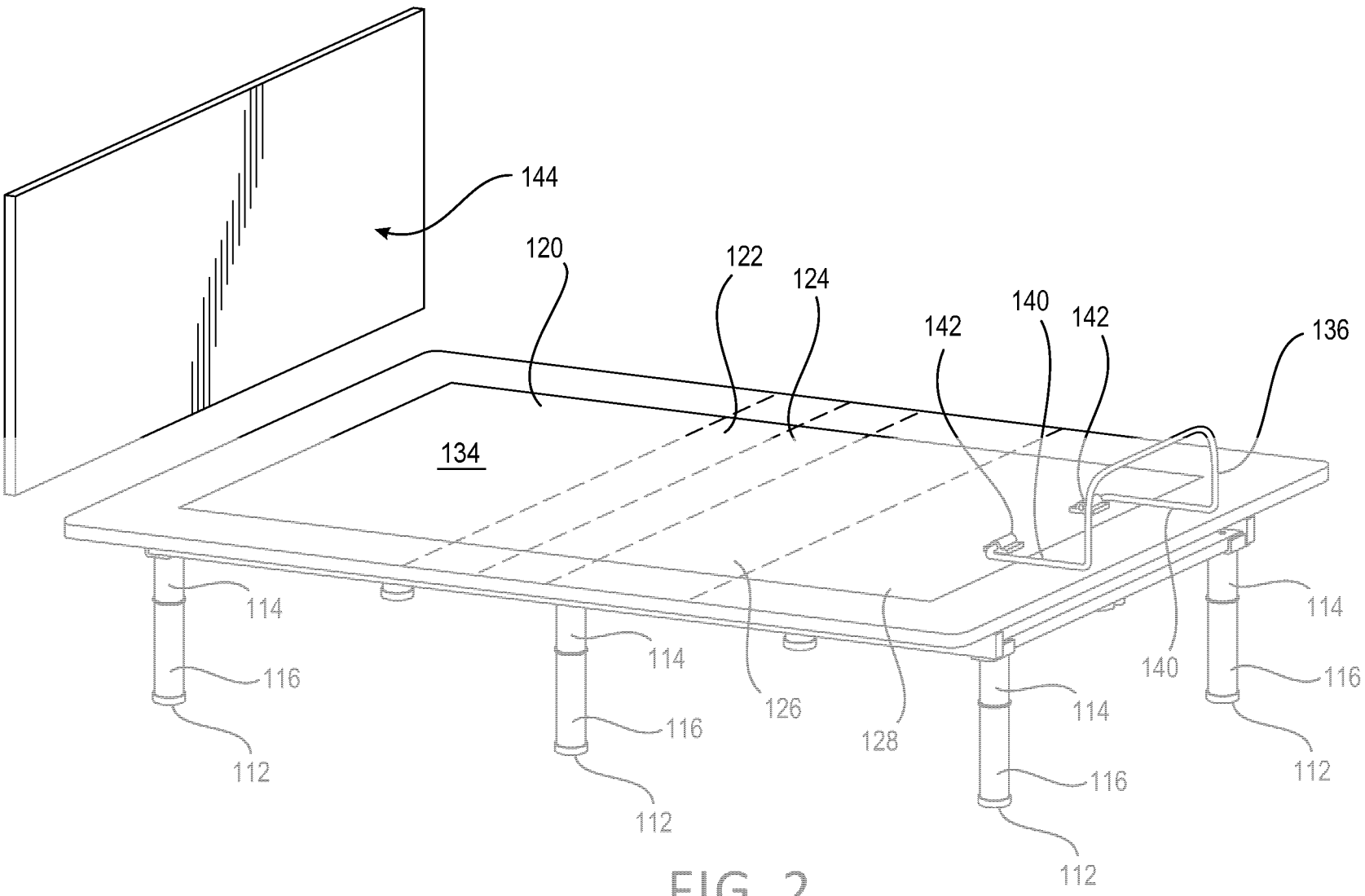
FIG. 2 is a perspective view of the new and improved ready-to-assemble (RTA) structural system for a bed, as illustrated within FIG. 1, wherein all of the deck members are disposed at their lowered states so as to define a horizontally oriented planar platform upon which a mattress may be disposed, and wherein further, padding or mattress cushions have also been schematically illustrated as covering each one of the head, lumbar, seat, thigh, and foot deck members so as to effectively define a single, substantially continuous padded surface or mattress cushion, with the individual deck members schematically separated by broken lines so as to diagrammatically illustrate the fact that the deck members comprise individual and separate deck members, each one of which is pivotally movable with respect to an adjacent one of the deck members, except for the seat deck which is fixedly secured to the bed frame, it being further noted that a headboard is adapted to be fixedly secured to the head end of the bed by means of suitable mounting brackets, and that a mattress retainer bar is installed atop the foot deck member of the system so as to properly position and confine a mattress atop the plurality of deck members and mattress cushion comprising the assembled bed system.
Figure 3:
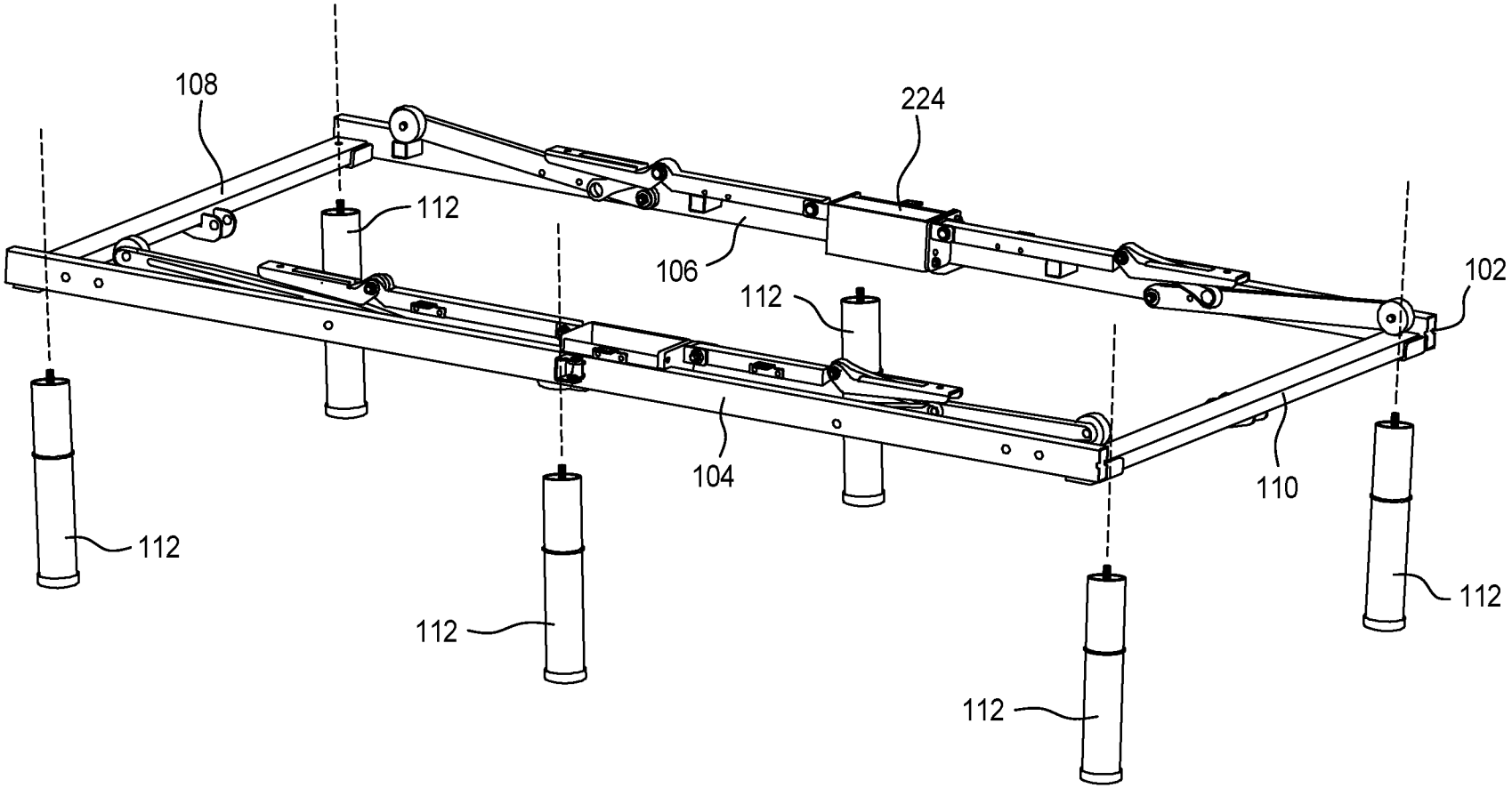
FIG. 3 is a partially exploded perspective view of the new and improved ready-to-assemble (RTA) structural system for a bed, as illustrated within FIG. 1, wherein the plurality of deck members have been removed so as to more clearly illustrate and disclose the various underlying support members, mounting brackets, and linkage components operatively associated with the plurality of deck members in order to move the plurality of deck members to various positions between their fully lowered and fully elevated positions, the various underlying support members, mounting brackets, and linkage components being shown at their lowered positions at which they are not as yet connected to the plurality of deck members.
Figure 10:
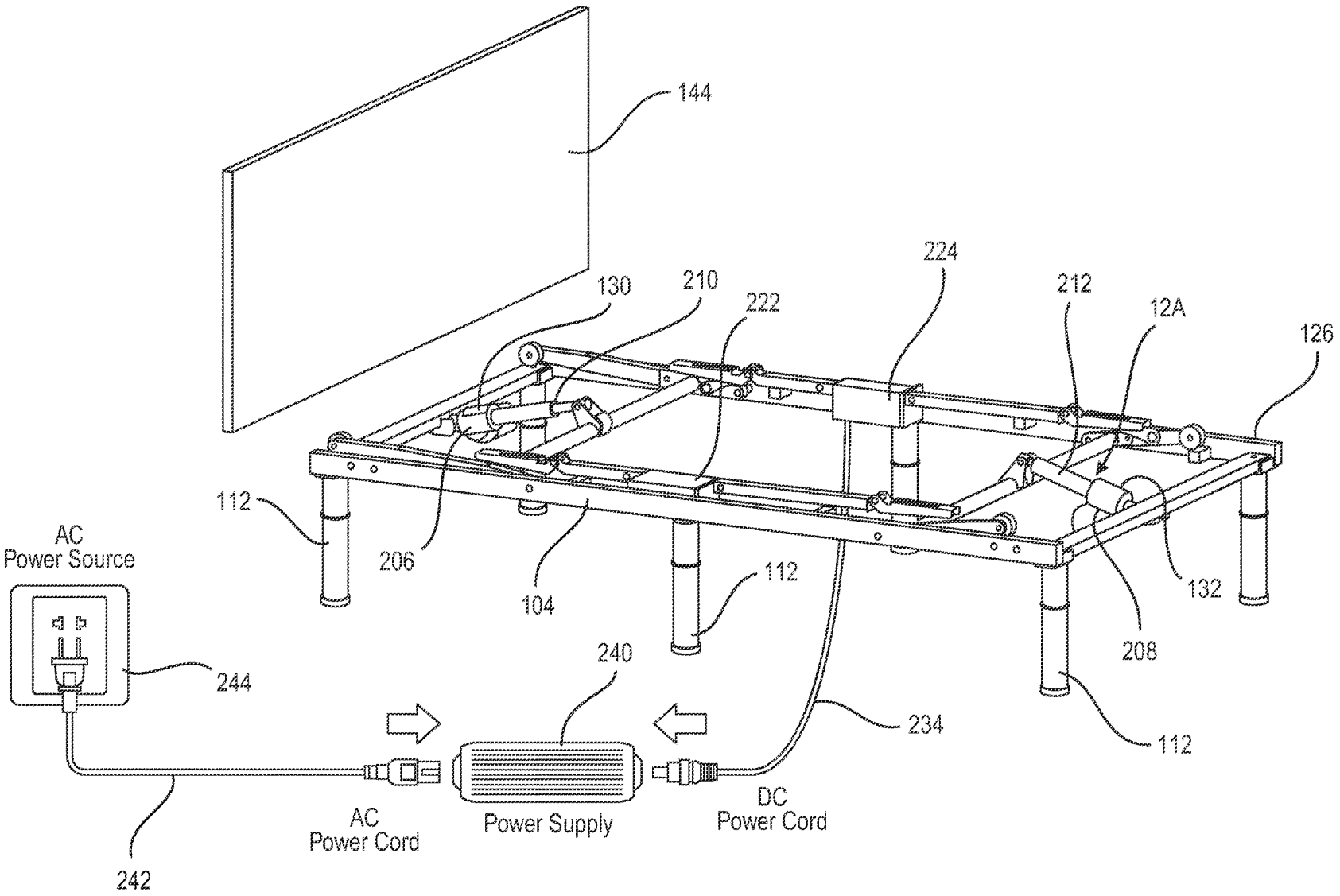
FIG. 10 is a perspective view similar to that of FIG. 6 showing the bed frame of the new and improved ready-to-assemble (RTA) structural system for a bed, wherein the power control box has been inserted into one of the power control box housings defined within one of the longitudinally extending frame members of the bed frame and has been electrically connected to an AC power source by means of an AC power cord, a power supply/converter which effectively converts the AC power to DC power, and a DC power cord.

With reference again being made to FIG. 1, it is seen that the new and improved structural system 100 for a bed, as constructed in accordance with the principles and teachings of the present invention, is seen to comprise a movable head deck member 120, a movable lumbar deck member 122, a fixed seat deck member 124, a movable thigh deck 126, and a movable foot deck member 126, wherein the movable head deck member 120, the movable lumbar deck member 122, the movable thigh deck member 126, and the movable foot deck 128 are movably mounted upon the bed frame 102 by means of a plurality of connectors, mounting brackets, and linkage members, as will be discussed more fully hereinafter, and are operatively controlled by means of respective head and foot linear actuators 130,132, as can best be seen, for example, within FIG. 10, wherein the linear actuators respectively comprise motors and telescopic tube mechanisms, as will also be discussed more fully hereinafter While each one of the deck members is fabricated from a relatively hard material, such as, for example, wood, metal, a suitable thermoplastic material, or the like, each one of the deck members 120-128 is encased within, or covered by means of, a suitable padding and fabric having a predetermined thickness and resilience, so as to effectively define a continuous mattress cushion 134, as schematically illustrated within FIG. 2, so as to provide the overall bed frame structural assembly with a substantially continuous, cushioned surface or bed platform, whereby an actual mattress for the bed can then be disposed atop the mattress cushion 134 when all of the movable deck members 120,122,126, 128 have been moved to their lowered positions so as to define a horizontally oriented bed platform. The plurality of deck members 120-128 are illustrated in dotted lines in FIG. 2 so as to schematically illustrate the fact that the bed platform is formed by means of the plurality of deck members 120-128 despite the fact that the horizontally oriented bed platform may appear to be a one-piece continuous structure as defined by means of the mattress cushion 134. A mattress retainer bar 136 may be secured to the upper surface portion of the mattress cushion 134, at a position close to or congruent with the edge portion of foot deck member 128, so as to retain the mattress upon the mattress cushion 134 and the underlying bed comprising the deck members 120-128 and the bed frame 102. As can best be seen from FIG. 2, the mattress retainer bar 136 comprises an upstanding portion 138, having a substantially inverted U-shaped configuration, and a pair of horizontally extending leg members 140,140, the ends of which are secured within suitable mounting brackets 142,142 fixedly secured to the upper surface portion of the foot deck member 128. Lastly, a headboard 144 is adapted to be fixedly attached to the transversely oriented end member 108 of the bed frame 102.

Figure 13:
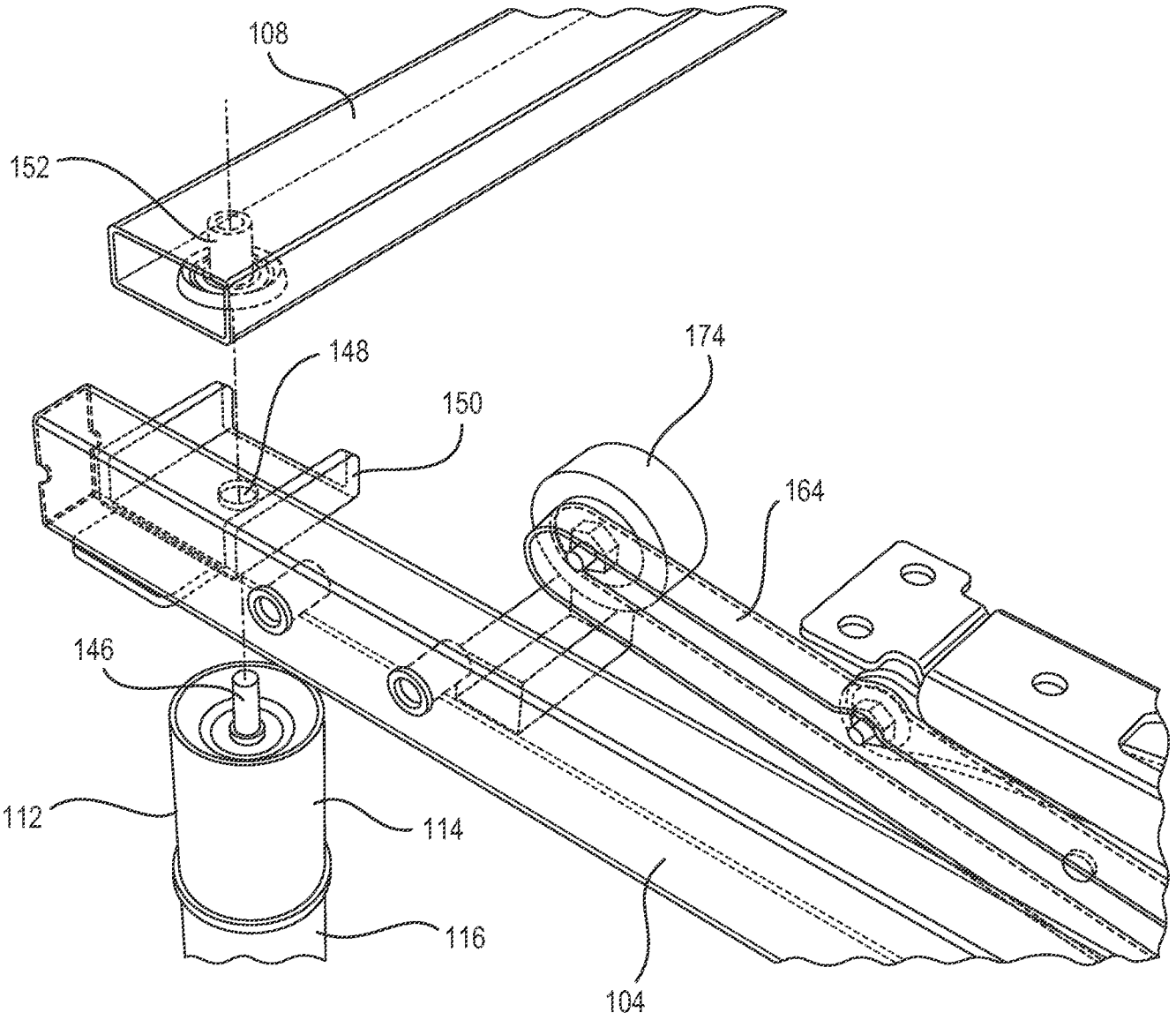
FIG. 13 is an enlarged, top perspective view of the left corner region of the bed frame of the new and improved ready-to-assemble (RTA) structural system for a bed, as illustrated within FIG. 3, illustrating how each one of the adjustable corner leg members of the new and improved ready-to-assemble (RTA) structural system for a bed has an upstanding threaded male connector member which is adapted to pass through a non-threaded bore provided within a mounting bracket affixed to an end portion of each one of the oppositely disposed longitudinally extending frame members of the bed frame of the new and improved ready-to-assemble (RTA) structural system, and is further adapted to be threadedly engaged with an internally threaded bore defined within an end portion of each one of the oppositely disposed transversely oriented end members of the bed frame of the new and improved ready-to-assemble (RTA) structural system for a bed such that each one of the corner leg members, the corner region of each one of the longitudinally extending frame members, and the corner region of each one of the transversely oriented frame members are fixedly secured together.
Figure 14:
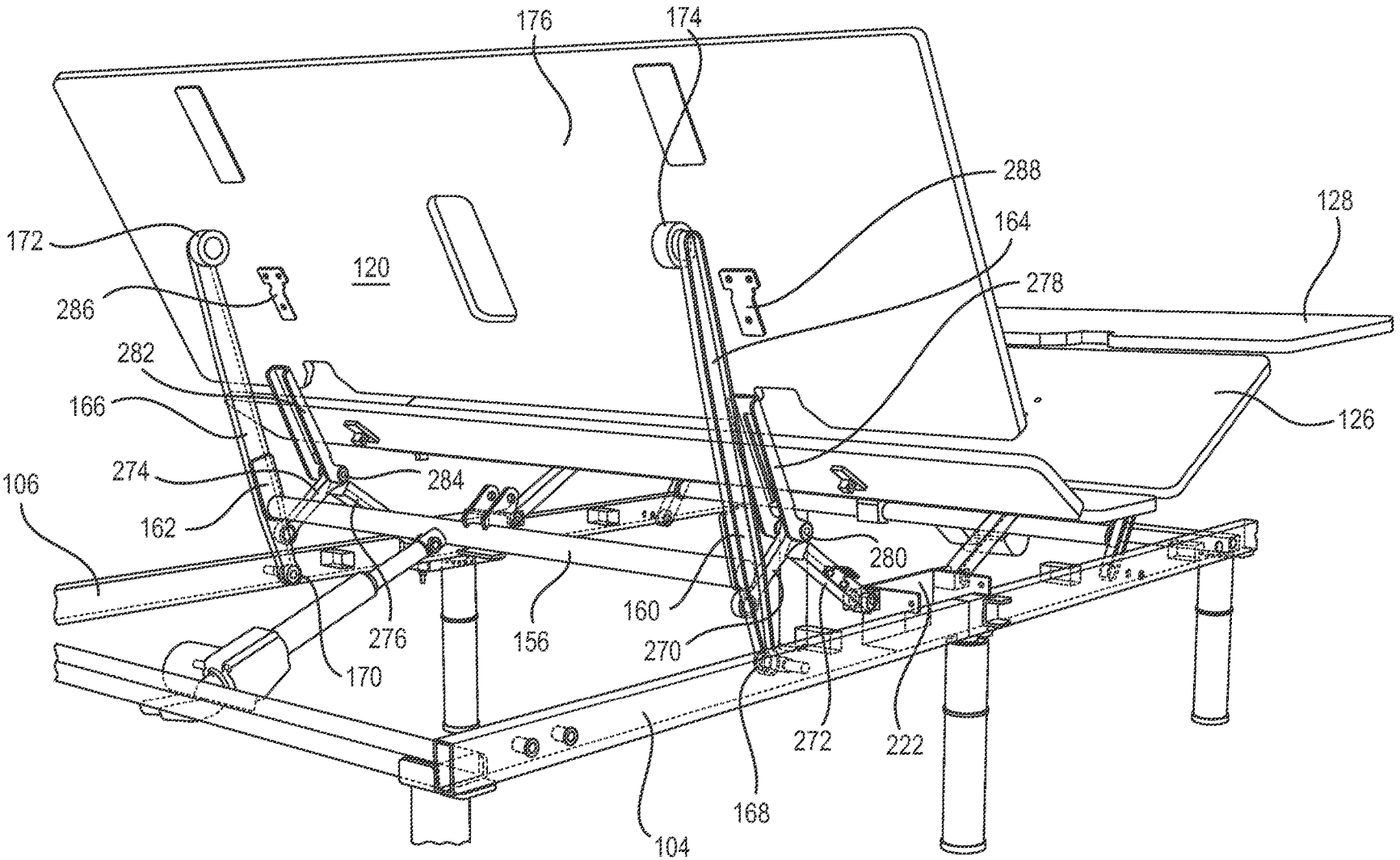
FIG. 14 is a perspective view of the new and improved ready to assemble (RTA) structural system for a bed from a perspective behind the head deck member such that the connections and movements of the various support members, mounting brackets, linkage members, head motor driving tube, and head linear actuator, can be better appreciated, FIG. 14 illustrating the pair of mounting brackets, operatively connected to the oppositely disposed longitudinally extending frame members, about to be connected to mounting clips mounted upon the rear surface of the head deck member.
Figure 15:
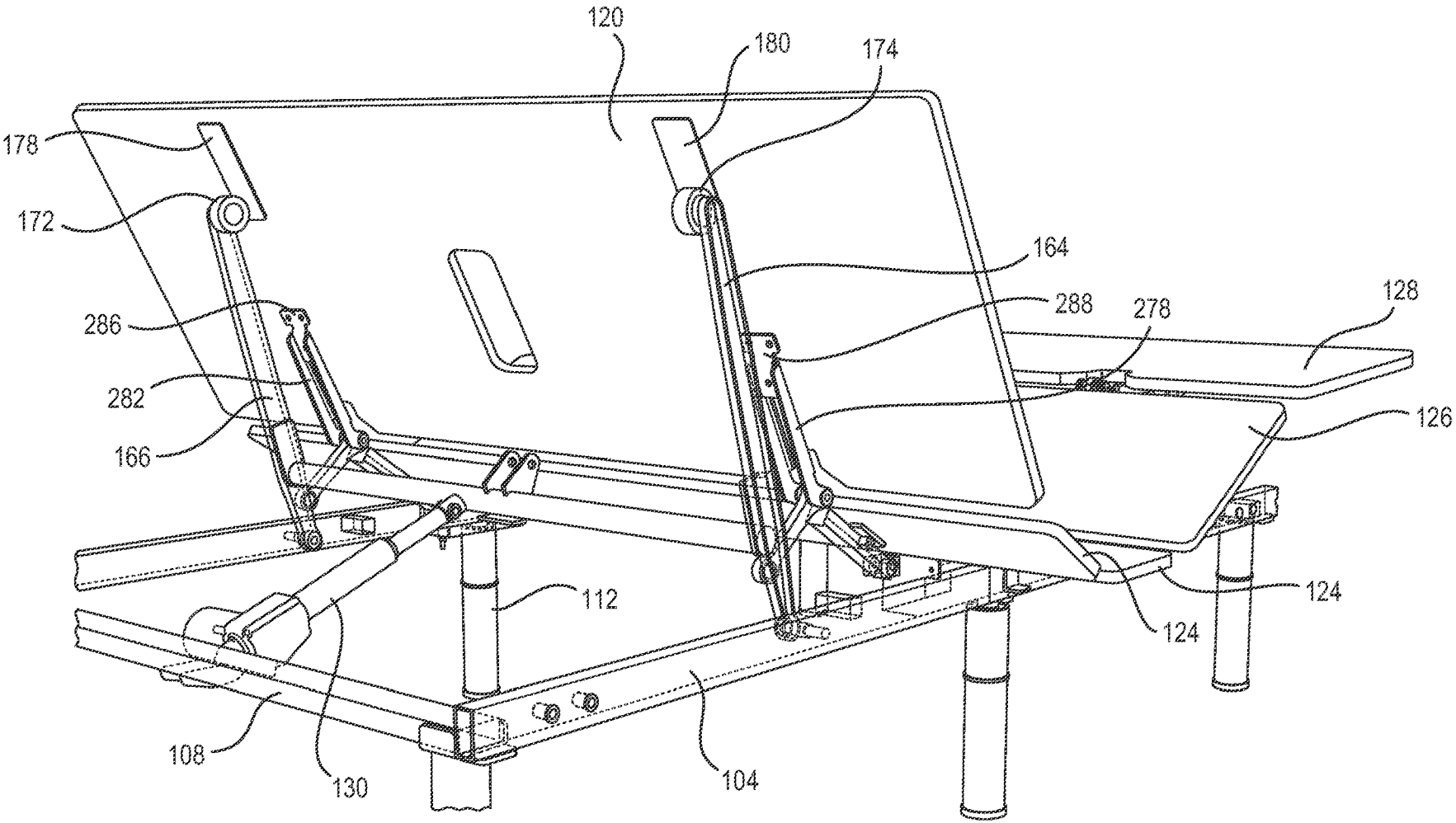
FIG. 15 is a perspective view similar to that of FIG. 14, wherein, however, the pair of mounting clips mounted upon the rear surface portion of the head deck member are connected to the pair of mounting brackets, operatively connected to the oppositely disposed longitudinally extending frame members, so as to fixedly mount the head deck member upon the bed frame of the new and improved ready to assemble (RTA) structural system for a bed.

Before describing the connections of the plurality of deck members 120-128 to the underlying bed frame 102, reference is made to FIG. 13 so as to more specifically describe, and complete the disclosure of, how the plurality of height-adjustable corner leg members 112 are not only fixedly secured to the bed frame 102 but, in addition, each one of the plurality of height-adjustable corner leg members 112 is utilized to fixedly secure the pair of longitudinally extending frame members 104,106 to the pair of transversely oriented end members 108,110. More particularly, as illustrated within FIG. 13, each one of the leg members 114,116 of each height-adjustable leg member 112 has an upstanding externally threaded male connector member 146 which is adapted to pass through a non-threaded bore 148 which is provided within a mounting bracket 150 which is affixed to an end portion of each one of the oppositely disposed longitudinally extending frame members 104 of the bed frame 102 of the new and improved ready-to-assemble (RTA) structural system 100, and is further adapted to be threadedly engaged within an internally threaded bore 152 defined within an end portion of each one of the oppositely disposed transversely oriented end members 108 of the bed frame 102 of the new and improved ready-to-assemble (RTA) structural system for a bed 100 such that each one of the corner leg members 112, the corner region of each one of the longitudinally extending frame members 104, and the corner region of each one of the transversely oriented frame members 108 are fixedly secured together. It is also to be understood that each one of the leg members 114,116 is provided with the upstanding externally threaded male connector member 146 and that the bottom or undersurface portion of each leg member 114 is provided with an internally threaded bore, not shown, such that the upper and lower leg members 114,116 may be threadedly connected together.

Figure 4:
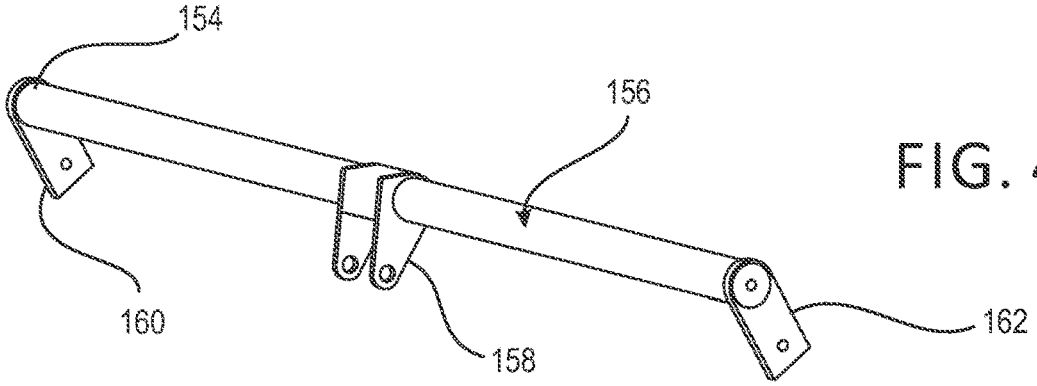
FIG. 4 is a perspective view of a head motor driving tube to be utilized in conjunction with the new and improved ready to assemble (RTA) structural system for a bed, and wherein, more particularly, the head motor driving tube is adapted to be operatively connected to the head and lumbar deck members so as to move the head and lumbar deck members between their various elevated and lowered positions as can be appreciated from FIG. 1.
Figure 5:
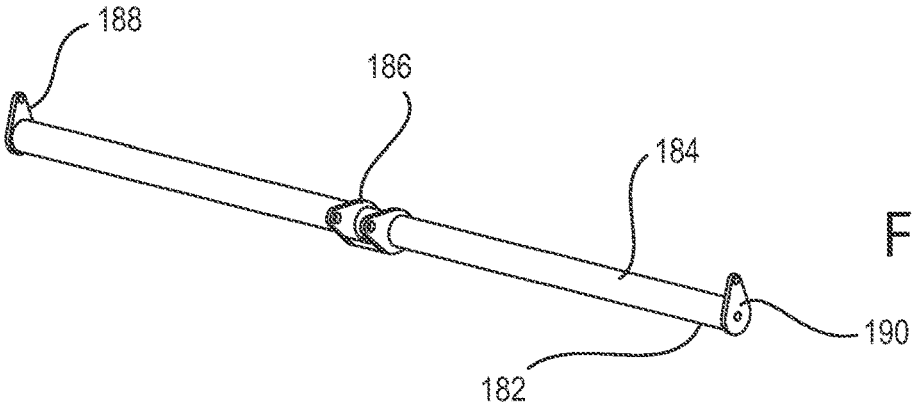
FIG. 5 is a perspective view of a foot motor driving tube to be utilized in conjunction with the new and improved ready to assemble (RTA) structural system for a bed, and wherein, more particularly, the foot motor driving tube is adapted to be operatively connected to the foot and thigh deck members so as to move the foot and thigh deck members between their various elevated and lowered positions as can be appreciated from FIG. 1.

With reference now being made to FIGS. 1, 4, 5, 6, 10-12B, and 14-17, the connections of the head, lumbar, thigh, and foot deck members 120,122, 126, and 128 to the underlying bed frame 102 will now be described. More particularly, it is seen that a head motor driving tube 154, as shown in FIG. 4, comprises a transversely oriented bar member 156 which is provided at its central portion with a clevis-type mounting bracket 158, and is provided, at its opposite ends, with a pair of mounting brackets 160,162. As can best be appreciated from FIG. 14, the end mounting brackets 160,162 of the head motor driving tube 154 are adapted to be fixedly connected to lower central portions of a pair of oppositely disposed support members 164,166 which have first end portions thereof pivotally connected to the pair of oppositely disposed longitudinally extending frame members 104,106 as at 168,170, while the opposite end portions of the support members 164,166 are respectively provided with rollers or wheels 172,174 which are adapted to roll along the rear surface portion 176 of the head deck member 120. As can best be seen in FIG. 15, rollers or wheels 172,174 are adapted to roll along wear strips or guide strips 178,180 which are fixedly connected to the rear surface portion 176 of the head deck member 120. In a similar manner, it is seen that a foot motor driving tube 182, as shown in FIG. 5, comprises a transversely oriented bar member 184 which is provided at its central portion with a clevis-type mounting bracket 186, and is provided, at its opposite ends, with a pair of mounting brackets 188,190. As can best be appreciated from FIG. 6, the end mounting brackets 188,190 of the foot motor driving tube 182 are adapted to be fixedly connected to lower central portions of a pair of oppositely disposed mounting connectors 192,194 which have their lower end portions pivotally connected to the pair of oppositely disposed longitudinally extending frame members 104,106 as at 196,198, while the upper end portions of the mounting connectors 192,194 are respectively provided with rollers or wheels 200,202 which are adapted to roll along the rear surface portion 204 of the foot deck member 128 as can best be appreciated from FIG. 17.

Figure 12A:
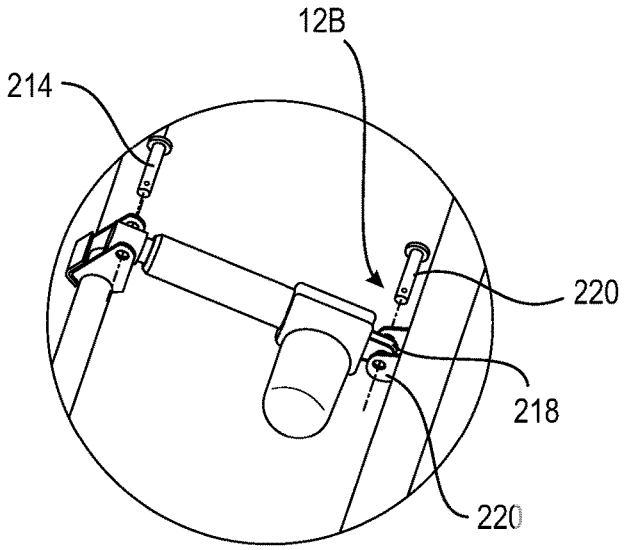
FIG. 12A is an enlarged view of the arrowhead region denoted 12A in FIG. 10 schematically illustrating the connection of the foot linear actuator to the foot motor driving tube and the transversely oriented end member of the bed frame disposed at the foot end of the bed frame while the connection of the head linear actuator to the head motor driving tube and the transversely oriented end member of the bed frame disposed at the head end of the bed frame is achieved in a similar manner.
Figure 12B:
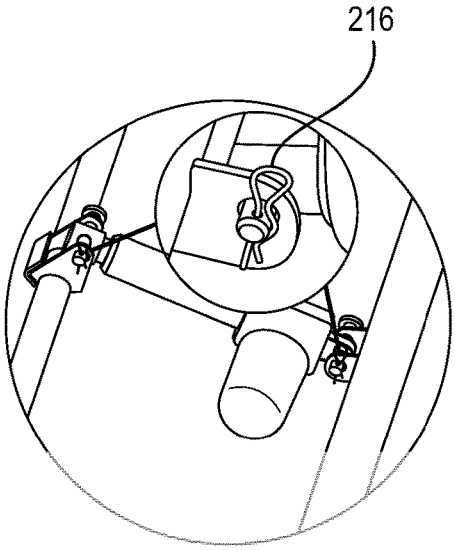
FIG. 12B is an enlarged view of the arrowhead region denoted 12B in FIG. 12A so as to illustrate how the linear actuator is actually fixedly secured or connected to the foot motor driving tube and the transversely oriented foot end member of the bed frame.

Continuing further, and with reference being especially made to FIGS. 10-12B, 14, and 15, the head and foot linear actuators 130,132 are adapted to be respectively connected to the head and foot motor driving tubes 154,182 as well as to the transversely oriented head and foot end frame members 108,110. More particularly, the head and foot linear actuators 130,132 respectively comprise actuator motors 206,208, and telescopic tubes 210,212. As can best be appreciated from FIGS. 10-12B, the distal ends of the telescopic tubes 210,212 are respectively connected to the clevis-type mounting brackets 158,186 of the head and foot motor driving tubes 154,182 as a result of the distal ends of the telescopic tubes 210,212 being inserted between the clevis-type mounting brackets 158,186, whereupon a headed cross-pin 214, as best seen in FIG. 12A, is inserted through each clevis-type mounting bracket 158,186 and the distal end of the telescopic tube 210,212. The connection is then secured by passing an R-clip fastener 216 through the end of the cross-pin 214 which is opposite the head end, as seen in FIG. 12B. In a similar manner, the motor ends of the linear actuators 130,132 are provided with motor mounting brackets, such as, for example, the motor mounting bracket 218 as shown in FIG. 12A, which is adapted to be inserted between clevis-type mounting brackets, such as, for example, the clevis-type mounting bracket 220 as shown in FIG. 12A, whereupon headed cross-pins 220, similar to the headed cross-pins 214, can be passed through the clevis-type mounting brackets 220 and secured by means of the R-clip fasteners 216.

Figure 9:
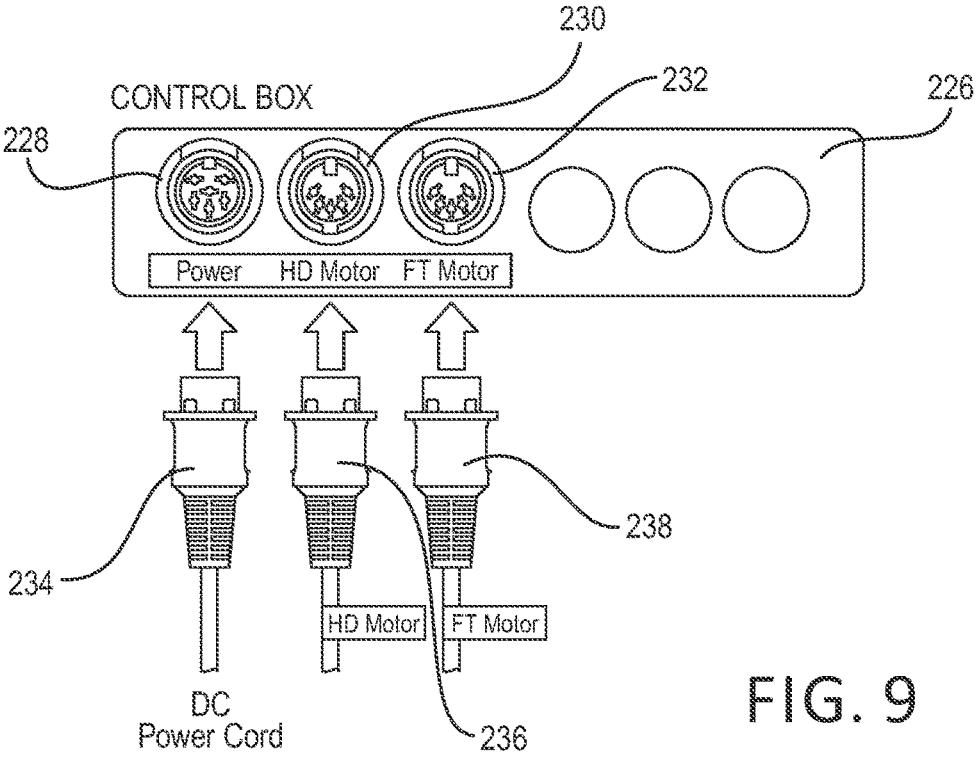
FIG. 9 is a diagram schematically showing the power control box which is to be inserted into and housed within one of the power control box housings which are defined within each one of the longitudinally extending frame members of the bed frame and to which the DC electrical power cord, the head motor power cord, and the foot motor power cord can be electrically connected.
Figure 6:
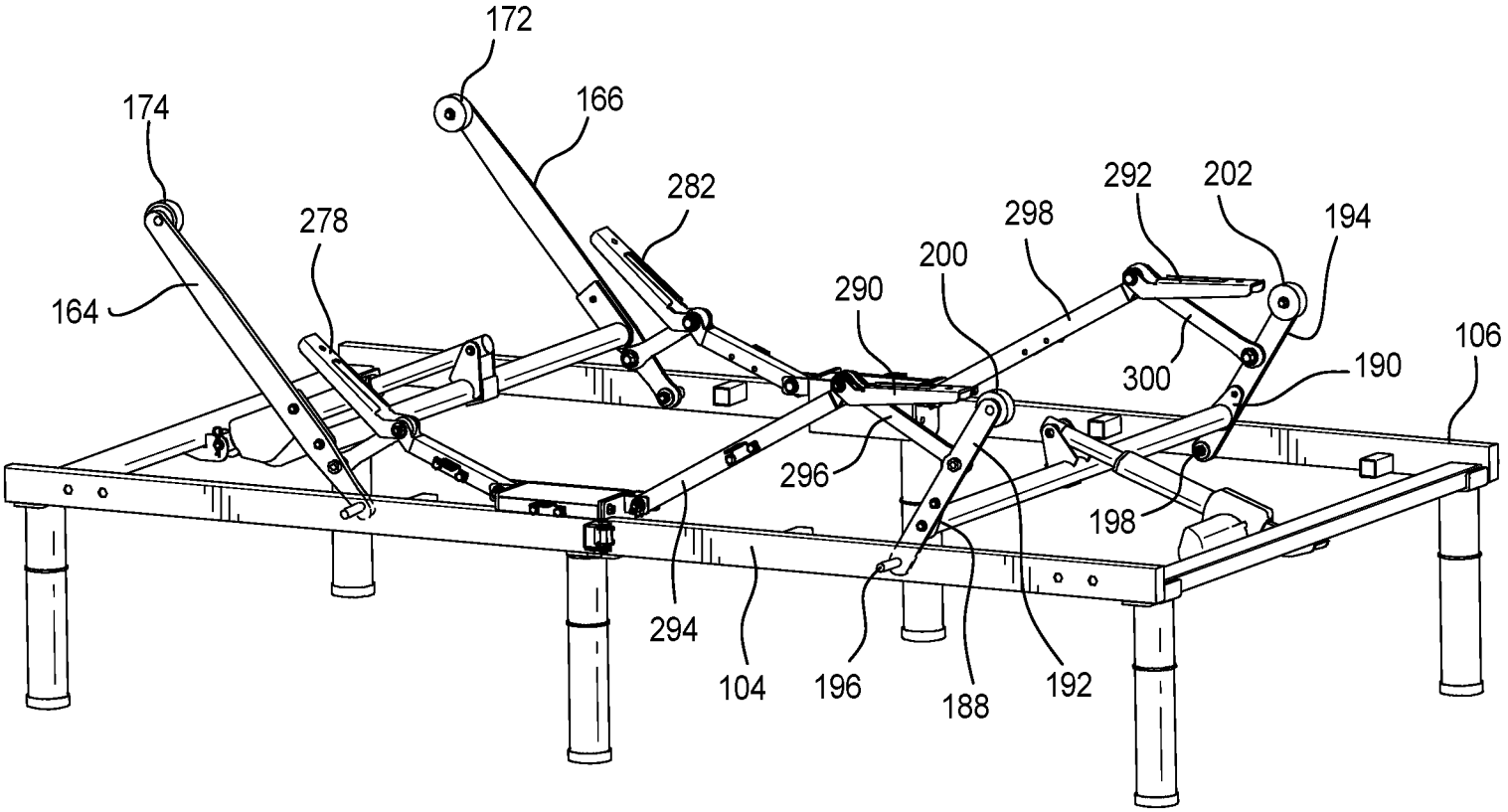
FIG. 6 is a perspective view of the new and improved ready-to-assemble (RTA) structural system for a bed, as illustrated within FIGS. 1 and 3, wherein the various underlying support members, mounting brackets, and linkage components, as well as the head and foot motor driving tubes, operatively associated with the plurality of deck members in order to move the plurality of deck members to various positions between their fully lowered and fully elevated positions, are illustrated so as to be connected to the head, lumbar, seat, thigh, and foot deck members, wherein the various underlying support members, mounting brackets, linkage components, head and foot motor driving tubes components have been actuated so that the plurality of deck members have been moved to their elevated positions as illustrated within FIG. 1.
Figure 7:
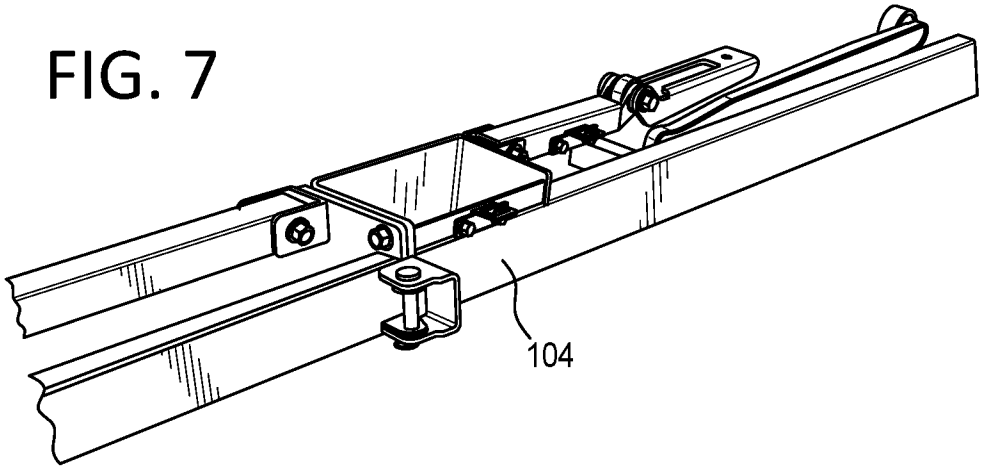
FIG. 7 is a perspective view of one of the longitudinally extending frame members of the bed frame of the new and improved ready-to-assemble (RTA) structural system for a bed, wherein the longitudinally extending frame member is illustrated in its fully extended state and upon which the support member, mounting bracket, and linkage components are mounted, along with a power control box housing which is adapted to contain a control box to which a DC electrical power cord, a head motor power cord, and a foot motor power cord can be connected.

With reference now being made to FIGS. 8-11D, it is to be noted, as can best be appreciated from FIGS. 8 and 10, that each one of the longitudinally extending frame members 104,106 is provided with a power control box housing 222,224 which is located at a substantially central location along the longitudinal extent of each one of the longitudinally extending frame members 104,106 and which has the configuration of a rectangular parallepiped so as to accommodate a power control box 226 which is shown in FIG. 9. As can also be seen from FIG. 9, the power control box 226 is provided with three electrical outlets 228,230,232 into which a DC power cord 234, a head motor power cord 236, and a foot motor power cord 238 are adapted to be inserted. As can be further appreciated from FIG. 10, the DC power cord 234 is electrically connected to a power supply 240 which is, in turn, connected to an AC power cord 242 which is electrically connected to an AC power source 244. The power supply 240 effectively converts AC electrical power into DC electrical power such that the DC electrical power may be transmitted to the power control box 226. As can also be appreciated from FIG. 11, the head and foot motor power cords 236,238 are routed through, for example, the longitudinally extending frame member 106, when the power control box 226 is mounted within the power control box housing 222 disposed upon the longitudinally extending frame member 106, such that the distal ends of the head and foot motor power cords 236,238 extend outwardly from opposite ends of the longitudinally extending frame member 106. As can be further appreciated from FIG. 11, the head and foot linear actuator motors 206,208 have electrical power cords 246,248 extending respectively outwardly therefrom which are adapted to be mechanically and electrically connected to the head and foot motor power cords 236,238. More particularly, as illustrated within FIGS. 11A and 11B, it is seen that the distal end portions of the head and foot motor power cords 236,238 are respectively provided with female socket portions 250,252, while the distal end portions of the electrical power cords 246,248, operatively connected to and extending outwardly from the head and foot linear actuator motors 206,208, are respectively provided with male plug portions 254,256 which are adapted to be inserted into the female socket portions 250,252 of the head and foot motor power cords 236,238. In this manner, as can be seen in FIG. 11C, the head and foot motor power cords 236,238 are now mechanically and electrically connected to the head and foot motor power cords 246,248 of the linear actuator motors 206,208. In addition, in order to ensure that such mechanical and electrical connections are not broken, it is seen from FIGS. 11A-11D that the distal end portions of the head and foot linear actuator motor power cords 246,248 are provided with male connection pins 258,260 while the distal end portions of the head and foot motor power cords 236,238 are provided with pivotal latch mechanisms 262,264 wherein the pivotal latch mechanisms 262,264 are provided with latching notches or recesses 266,268. Accordingly, a can be seen in FIGS. 11C and 11D, when the pivotal latch mechanisms 262,264 are moved to their latch positions, each one of the connection pins 258, 260 are inserted into a respective one of the latching notches or recesses 266,268 such that the head and foot motor power cords 236,238 are now securely connected to the head and foot motor power cords 246,248 of the linear actuator motors 206,208 so as to prevent inadvertent disconnection from each other.

With reference now being made to FIGS. 14-17C, the disclosure will now describe how, for example, the head, lumbar, thigh, and foot deck members of the new and improved structural system for a bed 100 are pivotally connected to the underlying bed frame 102. More particularly, it is seen that two pairs of linkage members 270, 272 and 274,276 are disposed upon opposite sides of the bed frame 102, and wherein the lower end portions of the linkage members 270 and 274 are respectively pivotally connected to the support members 164,166, while the lower end portions of the linkage members 272 and 276 are respectively pivotally connected to the power control box housings 222,224, only power control box housing 222 being visible. In addition, it is seen that the upper end portions of the first pair of linkage members 270,272 are both pivotally connected to each other as well as to a first upstanding mounting bracket 278 as at 280, while the upper end portions of the second pair of linkage members 274,276 are both pivotally connected to each other as well as to a second upstanding mounting bracket 282 as at 284. Still further, it is seen that a pair of mounting clips 286,288 are fixedly secured upon the rear surface portion 176 of the head deck member 120 whereby, as can be appreciated from FIGS. 14 and 15, as the mounting brackets 278,282 are inserted into the mounting clips 286,288, the head deck member 120 will be secured to the underlying bed frame 102. As can be appreciated from FIG. 6, similar components to those just described, are provided in order to similarly secure the thigh deck member 126 to the underlying bed frame 102. For example, brackets 290,292 would correspond to brackets 278,282, while linkage members 294,296 would correspond to linkage members 270,272, and linkage members 298,300 would correspond to linkage members 274,276.

Figure 16:
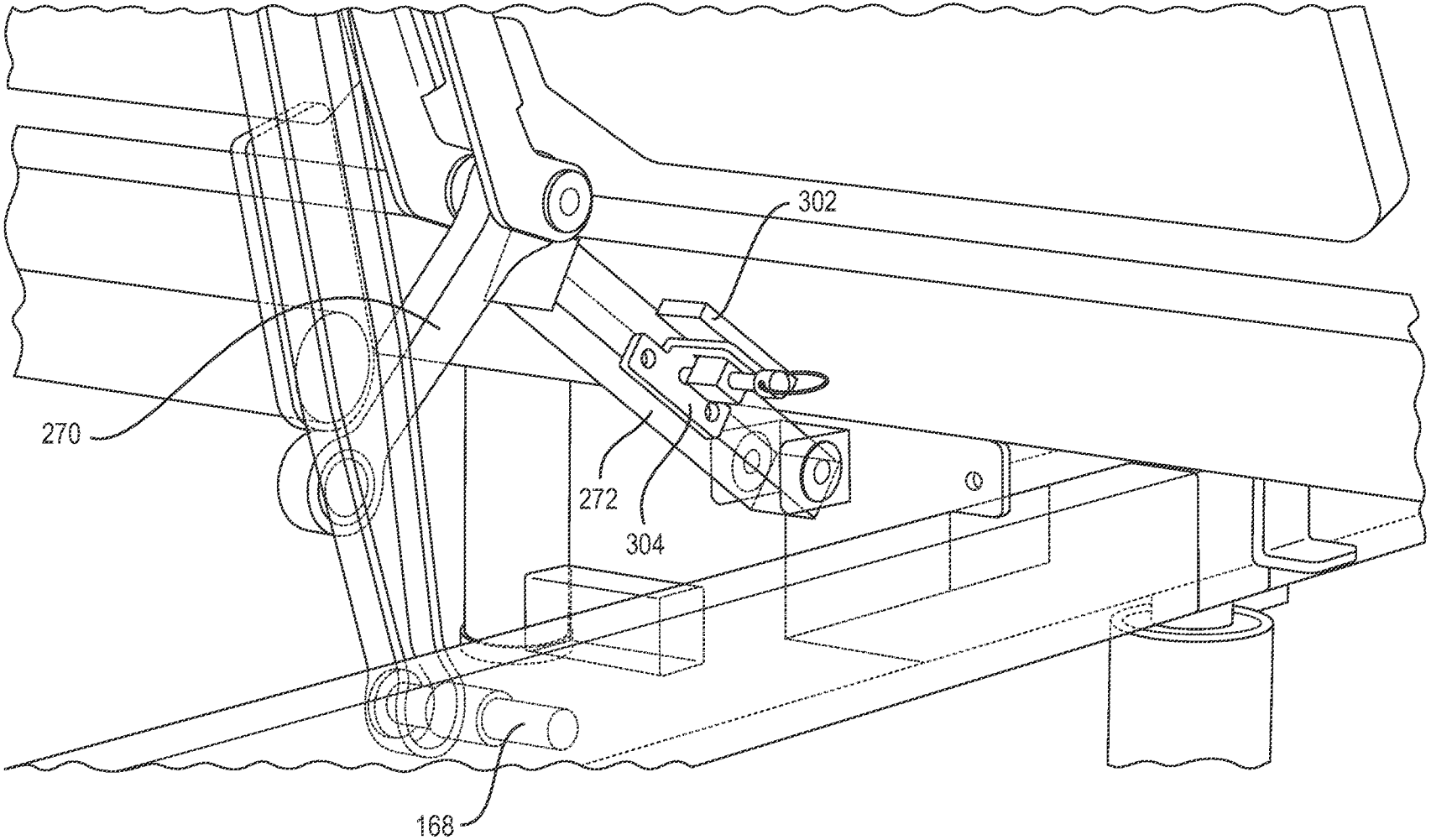
FIG. 16 is an enlarged portion of that region of the connection system illustrated within FIG. 15 wherein it is clearly illustrated how the pair of laterally spaced mounting brackets for the head deck member are connected to the pair of support members, mounted upon the pair of oppositely disposed longitudinally extending frame members, through means of pivotal linkage members, and how the lumbar deck member is fixedly secured to one of the pivotal linkage members by means of suitable quick-latch inserts, quick latch mounting brackets, and quick-latch pins.
Figure 17A:
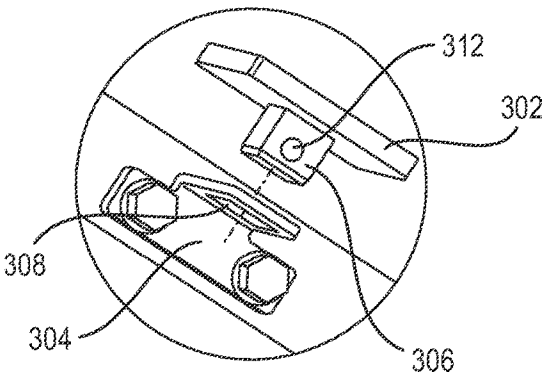
FIGS. 17A-17C are schematic detailed views of how the quick-latch inserts are inserted into the quick-latch mounting brackets, and are secured therein by means of the quick-latch pins, comprising the quick-latch system disclosed within FIG. 16 and utilized to fixedly secure the opposite sides of the lumbar deck member, the opposite sides of the seat deck member, and the opposite sides of the thigh deck member, respectively to the linkage system operatively associated with the head and lumbar deck members, the oppositely disposed power control box housings defined within the pair of oppositely disposed longitudinally extending frame members, and to the linkage system operatively associated with the thigh and foot deck members.
Figure 17C:
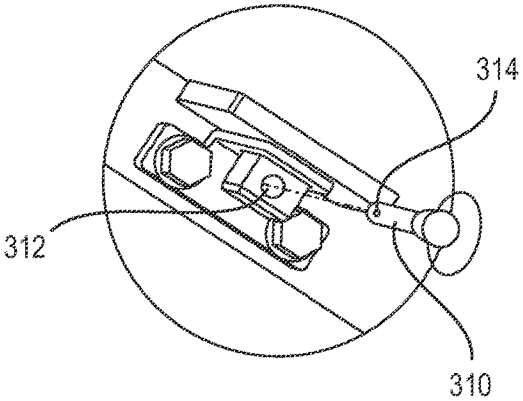
Figure 17:
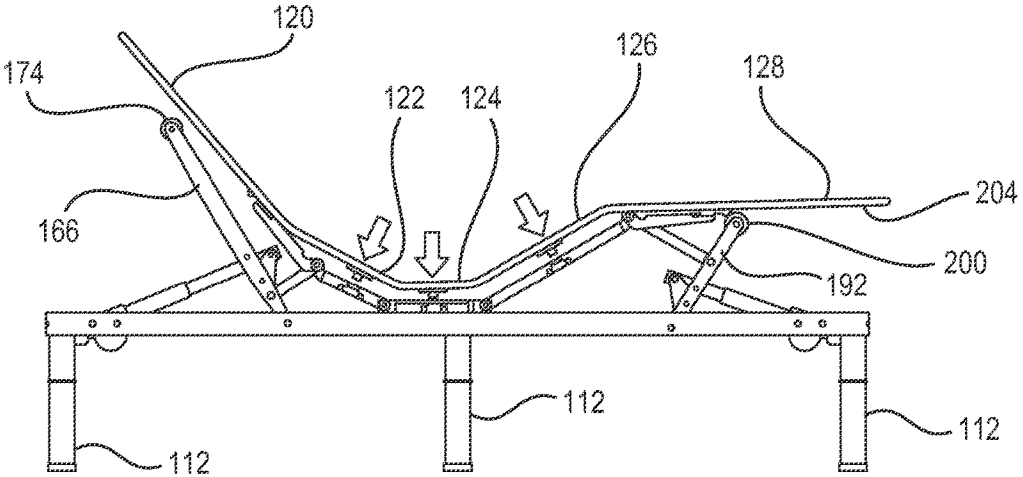
FIG. 17 is a schematic view illustrating how the opposite sides of the lumbar deck member, the opposite sides of the seat deck member, and the opposite sides of the thigh deck member, are respectively secured to the linkage system operatively associated with the head and lumbar deck members, the oppositely disposed power control box housings defined within the pair of oppositely disposed longitudinally extending frame members, and to the linkage system operatively associated with the thigh and foot deck members, by means of the quick-latch system disclosed within FIG. 16.
Figure 17B:
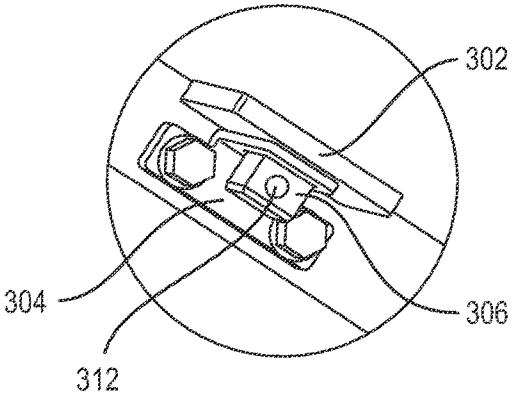

Continuing further, and as can be best appreciated from FIGS. 16-17C, in order to fixedly secure the lumbar deck member 122 to the underlying bed frame 102, quick latch inserts 302 are fixedly secured to undersurface portions disposed upon opposite sides of the lumbar deck member 122, and each one of the linkage members 272,276 is provided with a quick-latch mounting bracket 304. Each one of the quick latch inserts 302 includes a quick-latch insert tongue member 306, and each one of the quick-latch mounting brackets 304 includes a quick-latch mounting bracket slot 308 for receiving the tongue member 306 of the quick latch insert 302. Once the tongue member 306 of the quick-latch insert 302 has been inserted through the slot 308 of the quick-latch mounting bracket 304, as can best be appreciated from FIGS. 17A and 17B, a quick-latch pin 310 is inserted into a through-bore 312 defined within the tongue member 306 so as to fixedly retain the quick-latch insert 302 within the quick-latch mounting bracket 304. The distal end of the quick-latch pin 310 is provided with a spring-biased detent 314 which will be displaced so as to permit the quick-latch pin 310 to be inserted through the through-bore 312 of the tongue member 306 of the quick-latch insert 302, whereupon the distal end of the quick-latch 310 clearing the other side of the through-bore 321 of the tongue member 306, the spring-biased detent 314 will return to its original, unbiased position so as to fixedly secure the quick-latch pin 310 within the quick-latch mounting bracket 304. As can be additionally appreciated from FIG. 17, this quick-latch mounting system, comprising the quick-latch insert 302, the quick-latch mounting bracket 304, and the quick-latch mounting pin 310 is also utilized to fixedly secure the seat deck member 124 to the power control box housings 222, 224, as well as to fixedly secure the thigh deck member 126 to the linkage members 294,298.

Figure 18:
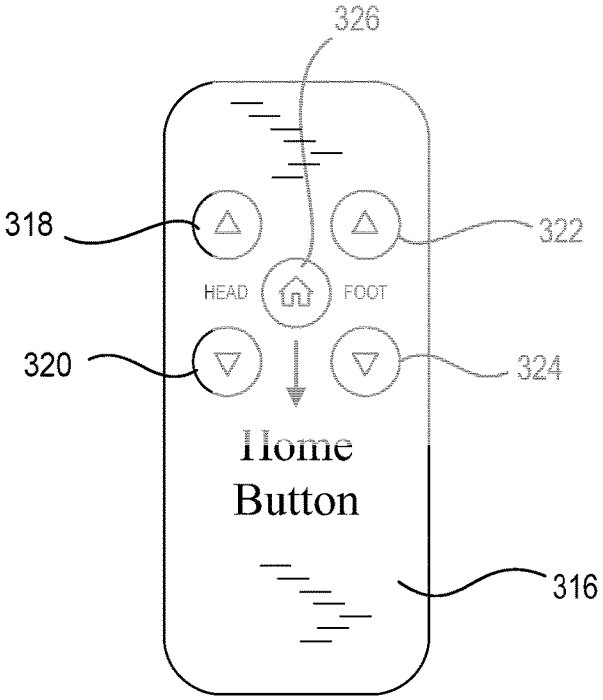
FIG. 18 is a schematic diagram of a remote control which can remotely control the elevation or lowering of the head, lumbar, thigh, and foot deck members.

With reference now being made to FIG. 18, a remote control 316 is disclosed which can remotely control the head and foot linear actuators 130,132 so as to achieve elevation or retraction of the head, lumbar, thigh, and foot deck members 120,122,126,128 relative to the underlying bed frame 102 through means of the previously described head motor driving tube 154, foot motor driving tuber 182, the support members 164,166, the mounting brackets 278,282, and the linkage members 270,272,274,276. It is to be noted that the remote control 316 comprises UP and DOWN buttons 318,320 for controlling the head linear actuator 130, while UP and DOWN buttons 322,324 are similarly provided for controlling the foot linear actuator 132. It is to be understood that in operation, the remote control 316 will transmit signals to the power control box 226 which will, in turn, transmit appropriate signals to the head and foot linear actuators 130,132. It is additionally noted that the motor drives 206,208 of the head linear actuator 130 and the foot linear actuator 132 can move their respective telescopic tubes 210,212 to any one of a multiplicity positions between their fully extended and fully retracted positions so as to, in turn, move the head and foot deck members 120,128, as well as the lumbar and thigh deck members 122,126, to a multiplicity of positions as may be desired. Lastly, the remote control 316 is provided with a HOME button 326 which, when depressed, retracts the linear actuators 130,132 such that all of the deck members 120,122,126, and 126 are turned to their horizontal orientations so as to form, along with the seat deck member 124, the horizontal bed platform as disclosed within FIG. 2.

Figure 19:
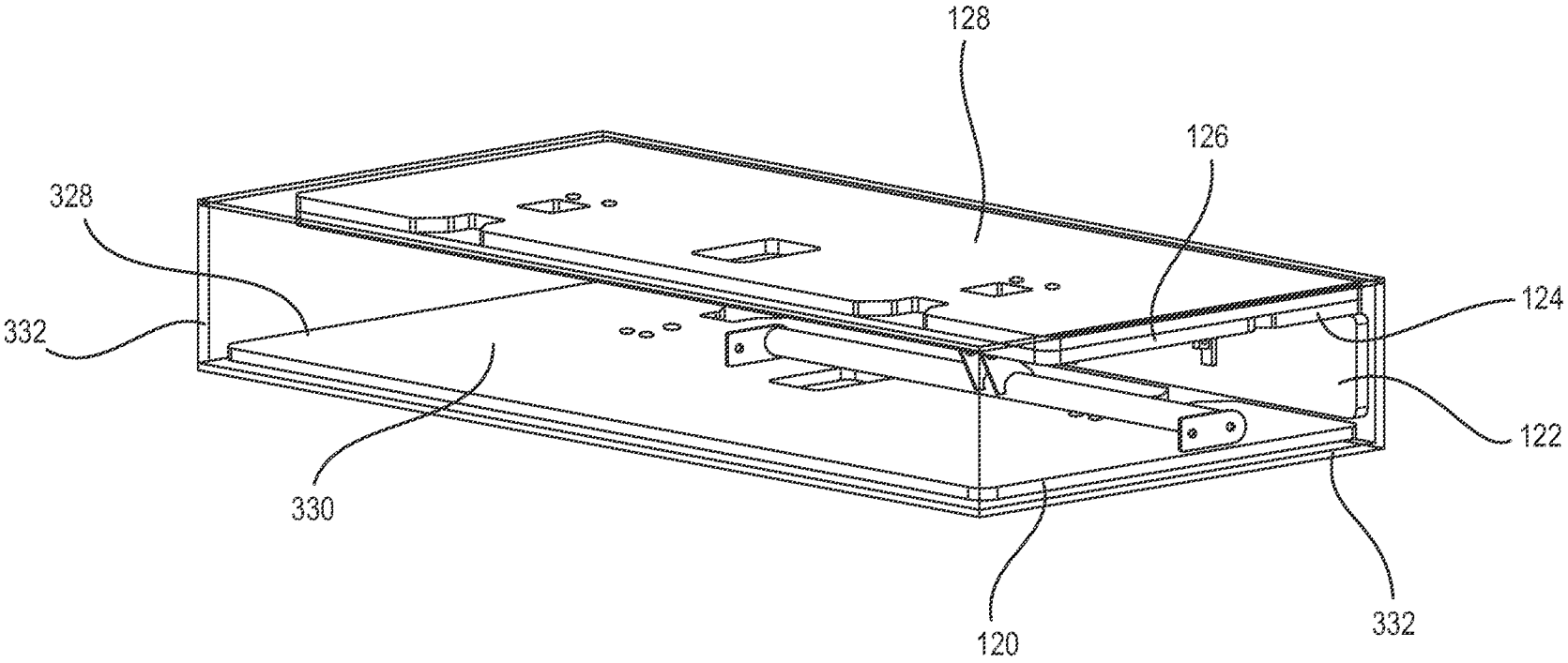
FIG. 19 is a perspective view of the head, lumbar, seat, thigh, and foot deck members which may be pivotally connected together so as to form a three-sided storage container defining an internal storage space within which the various components of the new and improved ready to assemble (RTA) structural system for a bed, other than the head, lumbar, seat, thigh, and foot deck members, can be stored such that the overall storage container, containing all of the structural components of the new and improved ready to assemble (RTA) structural system for a bed, defines a compact container with a relatively small footprint which is advantageous for storage and shipping or transportation purposes.

With reference lastly being made to FIG. 19, there is disclosed a three-sided storage container 328 which may effectively be formed as a result of pivotally connecting the head, lumbar seat, thigh, and foot deck members 120, 122,124,126,128 together and folding them with respect to each other so as to effectively define an internal storage space 330 within which the various components of the new and improved ready to assemble (RTA) structural system for a bed 100, other than the head, lumbar, seat, thigh, and foot deck members 120,122,124,126,128, can be stored such that the overall storage container 328, containing all of the structural components of the new and improved ready to assemble (RTA) structural system for a bed 100, defines a compact container with a relatively small footprint which is advantageous for storage and shipping or transportation purposes. In particular, it is noted that the head deck member 120 forms the bottom or floor of the storage container 328 and is first disposed within a lower box portion which forms the lower half of a packaging structure 332, the lumbar deck member 122 is then folded upwardly so as to form an upstanding side of the storage container 328, the seat deck member 124 and the thigh deck member 126 are then folded with respect to the upstanding lumbar deck member 122 which forms the upstanding side of the storage container 328 so as to form an upper or ceiling portion of the storage container 328 which is disposed parallel to the head deck member 120 forming the bottom or floor portion of the storage container 328, and the foot deck member 128 is folded on top of the seat and thigh deck members 124,126 so as to complete the three-sided storage container 328. Lastly, an upper box portion, not shown, and forming the upper half portion of the packaging structure 332, is disposed over the lower half portion of the packaging structure 332 such that the structure of the three-sided storage container 328 is enclosed within the packaging structure 332 and maintains the various components of the ready-to-assemble (RTA) structural system for a bed 100 inside the three-sided storage container 328.

Obviously, many variations and modifications of the present invention are possible in light of the above teachings. It is therefore to be understood that within the scope of the appended claims, the present invention may be practiced otherwise than as specifically described herein.

What is claimed is:

1. A ready-to-assemble structural system for a bed defining a predetermined footprint, comprising:

a bed frame;

said bed frame comprising a pair of oppositely disposed longitudinally extending members and a pair of oppositely disposed transversely oriented members wherein end portions of said pair of oppositely disposed transversely oriented members are connected to end portions of said pair of oppositely disposed longitudinally extending members so as to form corner regions of said bed frame;

a plurality of deck members mounted upon said bed frame so as to form a bed platform upon which a mattress may be disposed, said plurality of deck members, forming said bed platform, comprising a head deck member, a lumbar deck member, a seat deck member, a thigh deck member, and a foot deck member; and wherein said head deck member, said lumbar deck member, said seat deck member, said thigh deck member, and said foot deck member are pivotally connected together and configured to be folded in a predetermined manner, with said lumbar deck member being disposed perpendicular to said head deck member, said seat deck member and said thigh deck member being coplanar with respect to each other and being disposed perpendicular to said lumbar deck member, and said foot deck member being disposed parallel said seat deck member and said thigh deck member, so as to define a three-sided storage container defining an internal storage space wherein components of said structural system for said bed, other than said head deck member, said lumbar deck member, said seat deck member, said thigh deck member, and said foot deck member, can be stored in a compact manner whereby said footprint of said structural system for said bed is reduced.

2. The system as set forth in claim 1, wherein:

a plurality of leg members are fixedly secured to said bed frame so as to support said bed frame at a predetermined elevated position above a floor surface.

3. The system as set forth in claim 2, wherein:

said plurality of leg members are fixedly connected to said corner regions of said bed frame.

4. The system as set forth in claim 3, wherein:

said plurality of leg members are also fixedly connected to said bed frame at locations intermediate said end portions of said pair of opposite disposed longitudinally extending frame members.

5. The system as set forth in claim 2, wherein:

each one of said plurality of leg members comprises a height-adjustable leg member so as to support said bed frame at different predetermined elevated positions above the floor surface.

6. The system as set forth in claim 5, wherein:

each one of said plurality of height-adjustable leg members comprises a first leg member having a predetermined length, and a second member having a second predetermined length, wherein when only said first leg members are fixedly connected to said bed frame, said bed frame is disposed at a first predetermined elevation above the floor surface, when only said second leg members are fixedly connected to said bed frame, said bed frame is disposed at a second predetermined elevation above the floor surface, and when both said first and second leg members are connected together and are connected to said bed frame, said bed frame is disposed at a third predetermined elevation above the floor surface.

7. A ready-to-assemble structural system for a bed, comprising:

a bed frame;

said bed frame comprising a pair of oppositely disposed longitudinally extending members and a pair of oppositely disposed transversely oriented members wherein undersurface end portions of said pair of oppositely disposed transversely oriented members are connected to upper surface end portions of said pair of oppositely disposed longitudinally extending members so as to form corner regions of said bed frame;

a plurality of deck members mounted upon said bed frame so as to form a bed platform upon which a mattress may be disposed; and a plurality of leg members having upper end portions engaged with undersurface end portions of said pair of oppositely disposed longitudinally extending frame members and fixedly connected to end portions of said pair of oppositely disposed transversely oriented end members so as to capture said end portions of said oppositely disposed longitudinally extending frame members between said plurality of leg members and said end portions of said pair of oppositely disposed transversely oriented end members, whereby as a result of said connection of said plurality of leg members being fixedly connected to said end portions of said pair of oppositely disposed transversely oriented end members, each one of said plurality of leg members, each one of said end portions of said pair of oppositely disposed longitudinally extending members, and each one of said end portions of said pair of oppositely disposed transversely oriented members are simultaneously fixedly connected and engaged together.

8. The system as set forth in claim 7, wherein:

said plurality of deck members comprising said bed platform comprise a head deck member, a lumbar deck member, a seat deck member, a thigh deck member, and a foot deck member.

9. The system as set forth in claim 8, wherein:

said head deck member, said lumbar deck member, said thigh deck member, and said foot deck member are pivotally attached to said bed frame so as to be movable to different angular positions with respect to said bed frame, while said seat deck member is fixedly secured to said bed frame.

10. The system as set forth in claim 9, wherein:

said lumbar deck member is operatively connected to said head deck member;

a first actuator is operatively connected to said head deck member for moving said head deck member and said lumbar deck member to different angular positions with respect to said bed frame;

said thigh deck member is operatively connected to said foot deck member; and a second actuator is operatively connected to said foot deck member for moving said foot deck member and said thigh deck member to different angular positions with respect to said bed frame.

11. The system as set forth in claim 8, wherein:

said head deck member and said foot deck member are each operatively connected to said bed frame by means of at least one mounting bracket connected to said bed frame by linkage members, and at least one mounting clip mounted upon each one of said head and foot deck members and fixedly connected to said at least one mounting bracket.

12. The system as set forth in claim 11, further comprising:

support members pivotally attached at first ends thereof to said pair of oppositely disposed longitudinally extending members of said be frame;

rollers rotatably mounted upon second end portions of each one of said support members; and wear strips mounted upon rear surface portions of said head and foot deck members so as to permit said rollers to roll along said rear surface portions of said head and foot deck members without causing wear to said rear surface portions of said head and foot deck members.

13. The system as set forth in claim 7, wherein:

each one of said plurality of leg members comprises a height-adjustable leg member so as to support said bed frame at different predetermined elevated positions above the floor surface.

14. The system as set forth in claim 13, wherein:

each one of said plurality of height-adjustable leg members comprises a first leg member having a predetermined length, and a second member having a second predetermined length, wherein when only said first leg members are fixedly connected to said bed frame, said bed frame is disposed at a first predetermined elevation above the floor surface, when only said second leg members are fixedly connected to said bed frame, said bed frame is disposed at a second predetermined elevation above the floor surface, and when both said first and second leg members are connected together and are connected to said bed frame, said bed frame is disposed at a third predetermined elevation above the floor surface.

15. A ready-to-assemble structural system for a bed, comprising:

a bed frame;

said bed frame comprising a pair of oppositely disposed longitudinally extending members and a pair of oppositely disposed transversely oriented members wherein end portions of said pair of oppositely disposed transversely oriented members are connected to end portions of said pair of oppositely disposed longitudinally extending members so as to form corner regions of said bed frame; and a plurality of deck members mounted upon said bed frame so as to form a bed platform upon which a mattress may be disposed;

wherein said plurality of deck members forming said bed platform comprise a head deck member, a lumbar deck member, a seat deck member, a thigh deck member, and a foot deck member;

said head deck member and said foot deck member are each operatively connected to said bed frame by means of at least one mounting bracket connected to said bed frame by linkage members; and wherein said lumbar deck member and said thigh deck member are respectively operatively connected to said head deck member and said foot deck member by means of at least one quick-latch insert mounted upon each one of said lumbar and thigh deck members, at least one quick-latch mounting bracket mounted upon each one of said linkage members for receiving said at least one quick-latch insert mounted upon each one of said lumbar and thigh deck members, and at least one quick-latch pin for insertion through said at least one quick-latch insert so as to maintain said at least one quick-latch insert within said at least one quick-latch mounting bracket.

16. The system as set forth in claim 15, further comprising:

a power control box housing mounted upon each one of said pair of oppositely disposed longitudinally extending members; and a power control box disposed within one of said power control box housings for receiving electrical power from a power source and for providing electrical power to first and second actuators.

17. The system as set forth in claim 16, wherein:

said seat deck member is fixedly secured to each one of said power control box housings by a pair of quick-latch inserts mounted upon opposite sides of said seat deck member, a pair of quick-latch mounting brackets mounted upon each one of said power control box housings, and at least one quick-latch pin for maintaining said pair of quick-latch inserts connected to said quick-latch mounting brackets.

18. The system as set forth in claim 16, further comprising: a remote control, operatively connected to each one of said power control boxes such that each one of said power control boxes is operatively connected to said first and second actuators such that said first and second actuators so as to control elevated and retracted movements of said head and foot deck members.

19. The system as set forth in claim 15, wherein:

each one of said plurality of deck members is fabricated from a material selected from the group comprising metal, wood, and a thermoplastic material; and each one of said plurality of deck members is encased within a padding such that said plurality of padded deck members define a mattress cushion upon which a mattress may be disposed.

* * * * *